US007026107B2

(12) United States Patent
Shirai

(10) Patent No.: US 7,026,107 B2
(45) Date of Patent: Apr. 11, 2006

(54) SILVER HALIDE COLOR PHOTOSENSITIVE MATERIAL

(75) Inventor: Hideyuki Shirai, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/989,077

(22) Filed: Nov. 16, 2004

(65) Prior Publication Data

US 2005/0142504 A1 Jun. 30, 2005

(30) Foreign Application Priority Data

Nov. 18, 2003 (JP) ..... 2003-388405

(51) Int. Cl.
*G03C 1/46* (2006.01)

(52) U.S. Cl. ..... 430/502; 430/503; 430/512; 430/931; 430/559; 430/567

(58) Field of Classification Search ..... 430/502, 430/503, 512, 931, 559, 567
See application file for complete search history.

(56) References Cited

U.S. PATENT DOCUMENTS 5,385,815 A * 1/1995 Schofield et al. ..... 430/512
5,399,469 A * 3/1995 Szajewski ..... 430/503

* cited by examiner

*Primary Examiner*—Geraldine Letscher
(74) *Attorney, Agent, or Firm*—Sughrue Mion, PLLC

(57) ABSTRACT

A silver halide color photosensitive material composing respectively at least one red-, green-, and blue-sensitive silver halide emulsion layer, the color photosensitive material containing a magenta dye which is fixed in the specific layer and is not colored by a coupling reaction with developing agent oxidation products, and/or containing a cyan dye which is fixed in the specific layer and is not colored by a coupling reaction with developing agent oxidation products, and containing an ultraviolet absorptive polymer latex represented by the formula (I) which is impregnated with a non high molecular weight ultraviolet absorptive compound.

(I)

wherein a phenyl ring or a benzo ring may be optionally substituted, either of m or n is 1 and another is 0, and M and K are represented by the following formula (II):

(II)

wherein R3 is H or an alkyl group, L is a divalent binding group, and p is 0 or 1.

4 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2003-388405, filed Nov. 18, 2003, the entire contents of which are incorporated herein by reference.

BACKGROUND OF THE INVENTION

1. Field of the Invention

The present invention relates to a silver halide color photosensitive material, and more specifically, relates to a silver halide color photosensitive material excellent in scratch resistance and preserving property and excellent in sharpness.

2. Description of the Related Art

A silver halide color photosensitive material, in particular, a photographing material is required to be high sensitive and excellent in sharpness. As a method of improving the sharpness, for example, means for improving the sharpness by a fixed dye, and by combining the fixed dye and tabular grains is disclosed (for example, refer to Jpn. Pat. Appln. KOKAI Publication (hereinafter referred to as JP-A) 7-128789). However, although the improvement of the sharpness is observed by this means, further improvement has been desired. On the other hand, as a method of improving scratch resistance, means for improving the scratch resistance by containing an ultraviolet absorptive polymer latex which is impregnated with a non high molecular weight ultraviolet absorptive compound is disclosed, but the sharpness is not mentioned (for example, refer to U.S. Pat. No. 5,385,815).

BRIEF SUMMARY OF THE INVENTION

An object of the present invention is to provide a silver halide color photosensitive material excellent in scratch resistance and preserving property and excellent in sharpness.

As a result of intensive study, the inventors have found that the above-mentioned problems can be solved by a silver halide color photosensitive material described below and completed the present invention.

(1) A silver halide color photosensitive material having photographic composing layers including at least one red-sensitive silver halide emulsion layer, at least one green-sensitive silver halide emulsion layer and at least one blue-sensitive silver halide emulsion layer in order from the side near a support, the silver halide color photosensitive material containing a magenta dye which is fixed in the photographic composing layer which exists at a position farther than the green-sensitive silver halide emulsion layer with a support as a basis and is not colored by a coupling reaction with developing agent oxidation products, and/or containing a cyan dye which is fixed in the photographic composing layer which exists at a position farther than the red-sensitive silver halide emulsion layer with a support as a basis and is not colored by a coupling reaction with developing agent oxidation products, and containing an ultraviolet absorptive polymer latex represented by the formula (I) which is impregnated with a non high molecular weight ultraviolet absorptive compound in at least one photographic composing layer.

Formula (I)

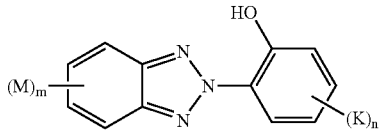

wherein a phenyl ring or a benzo ring may be optionally substituted, either of m or n is 1 and another is 0, and M and K are represented by the following formula (II):

Formula (II)

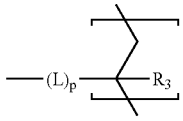

wherein R3 is H or an alkyl group, L is a divalent binding group, and p is 0 or 1.

(2) The silver halide color photosensitive material according to item (1) above, wherein the magenta dye or the cyan dye which is not colored by a coupling reaction with developing agent oxidation products is contained in the same layer as the polymer latex-containing layer or a layer which exists at a position farther than the polymer latex-containing layer.

(3) The silver halide color photosensitive material according to item (1) or (2) above, wherein at least 50% or more of the total projected area of the silver halide grains contained in the blue-sensitive silver halide emulsion layer which exists at a position farthest from the support is occupied by tabular silver halide grains with an aspect ratio of 3 or more.

DETAILED DESCRIPTION OF THE INVENTION

The present invention will be specifically illustrated below. The "magenta dye which is not colored by a coupling reaction with developing agent oxidation products" in the present invention may be a dye having substantially a spectral absorptive maximum wavelength at 500 to 600 nm in a dry film of a photosensitive material containing the dye added thereto, and the dye may be alone or 2 or more may be used in combination.

The "cyan dye which is not colored by a coupling reaction with a developing agent oxidation products" in the present invention may be a dye having substantially a spectral absorptive maximum wavelength at 600 to 700 nm in a dry film of a photosensitive material containing the dye added thereto, and the dye may be alone or 2 or more may be used in combination.

In present invention, the meaning that a dye is fixed is that the dye added at preparation of the objective layer exists substantially in the objective layer without being scattered out of the objective layer also after manufacture. Hereat, "existing substantially in the objective layer" means that 80% or more of the dye added exists in the objective layer. Means for fixing the dye in the objective layer may be any method, but for example, there are the following methods.

The method of adding a dye in the objective layer includes a method of directly dying gelatin, a method of dissolving a dye by an oil-in-water dispersion method which is described later, a method of dissolving a dye by using a high boiling organic solvent having a boiling point of 175° C. or more at normal pressure, if necessary, by using also an organic solvent having a boiling point of 50° C. or more and 160° or less, and emulsifying and dispersing the solution in a gelatin aqueous solution containing a surfactant to be added, a method of adding a so-called solid-dispersed dye described in the brochure of International Patent (Unexamined) 88/4974, JP-A-1-502912 and the specification of EP (Unexamined) 456,148 or a method of preventing the scattering of a dye through a polymer mordant agent. Example of the typical polymer mordant agent is an agent described in the [Chem 9] of JP-A-5-188548. In the present invention, any one of these methods can be used but addition by the oil-in-water dispersion method is preferable in particular.

In the present invention, the amount of the magenta dye added in the dry film of the objective layer is preferably an average optical density which is at a wavelength of 500 to 600 nm for the magenta dye and that of 600 to 700 nm for the cyan dye of 0.005 to 0.50 and more preferably 0.02 to 0.30. The density is determined as below. The real measurement method determines the average optical density at 500 to 600 nm or 600 to 700 nm from an integrated value obtained by measuring the density at 500 to 600 nm or 600 to 700 nm of a sample obtained by coating a dye together with gelatin on a transparent support to be dried, with a spectral photometer.

The fixed magenta dye of the present invention is required to be contained in the photographic composing layer which exists at a position farther than the green-sensitive layer with a support as a basis. Further, the fixed cyan dye of the present invention is required to be contained in the photographic composing layer which exists at a position farther than the red-sensitive layer with a support as a basis.

The specific examples of the magenta dye and cyan dye used for the present invention are shown below, but the present invention is not limited to these.

D-1

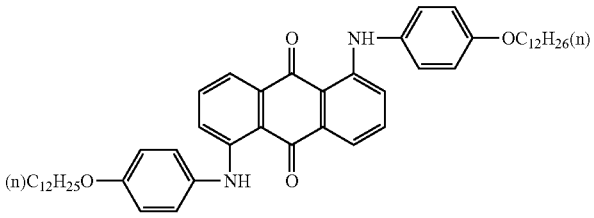

D-2

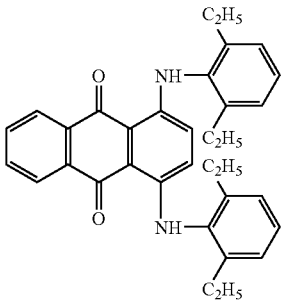

D-3

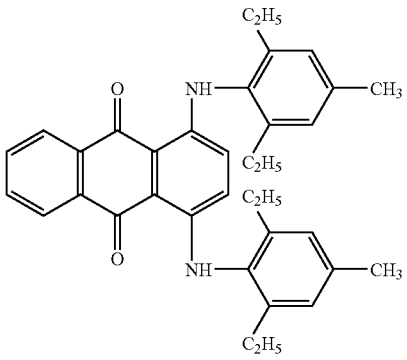

D-4

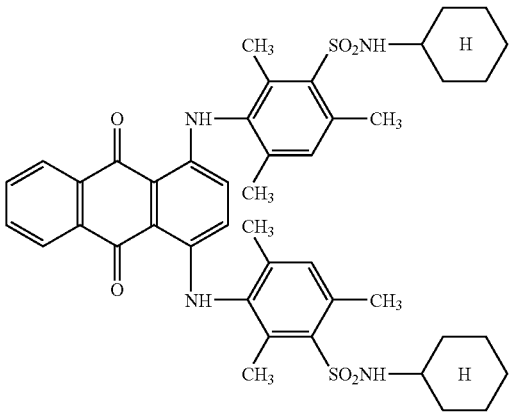

D-5

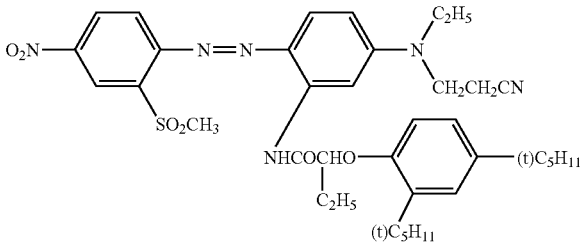

D-6

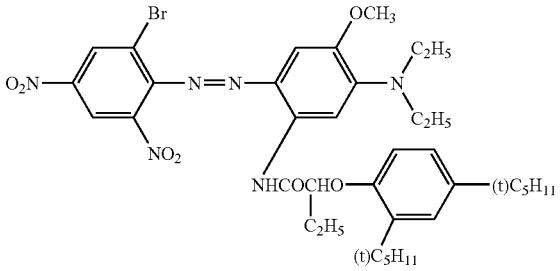

-continued
D-7
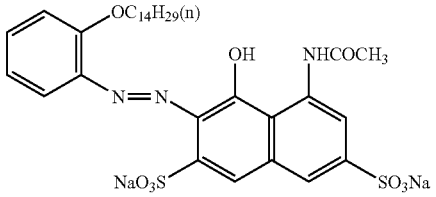
D-8
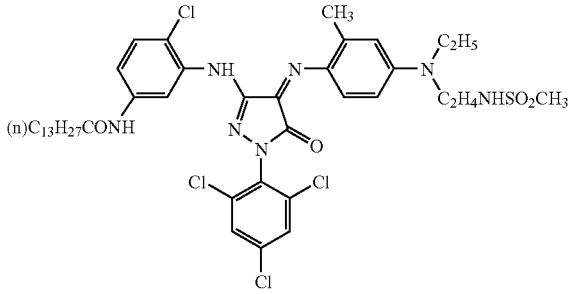
D-9
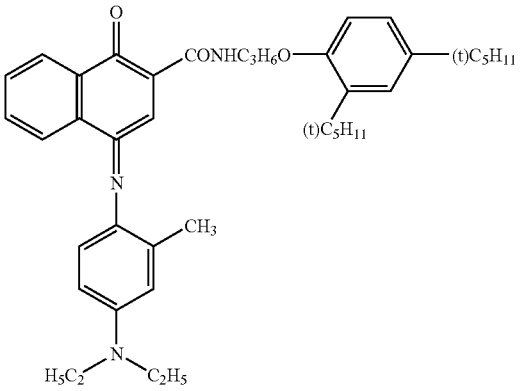
D-10
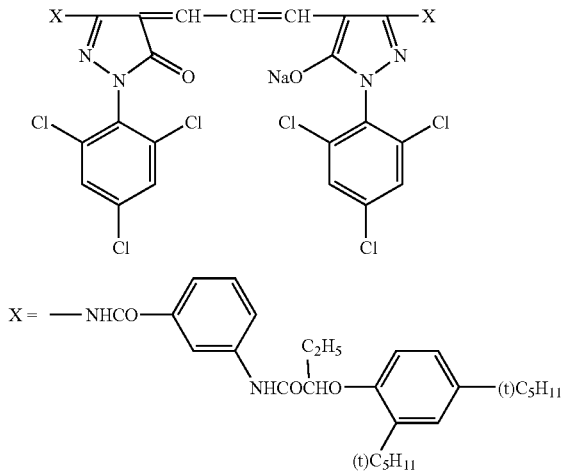
D-11
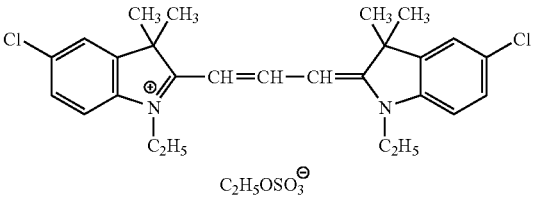
D-12
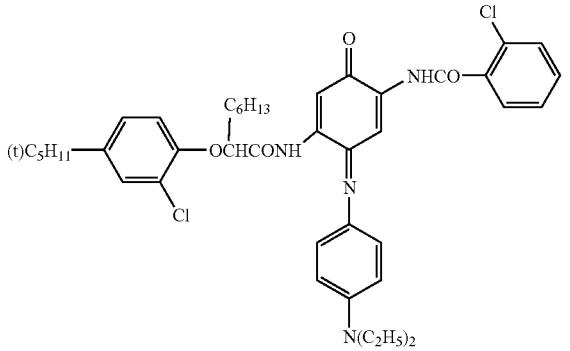
D-13
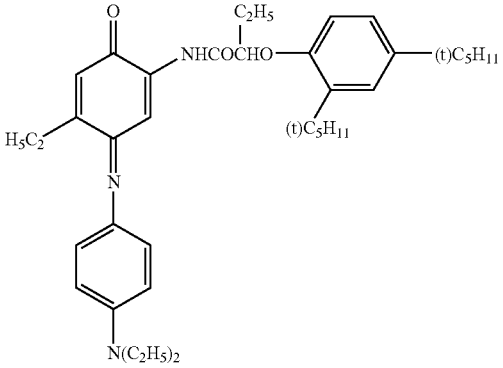
D-14
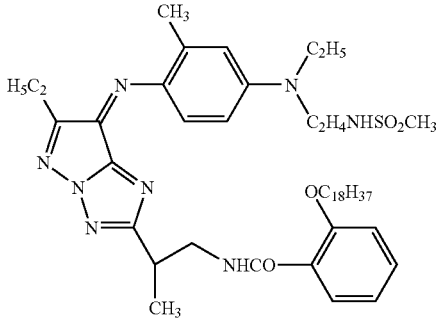

-continued
D-15
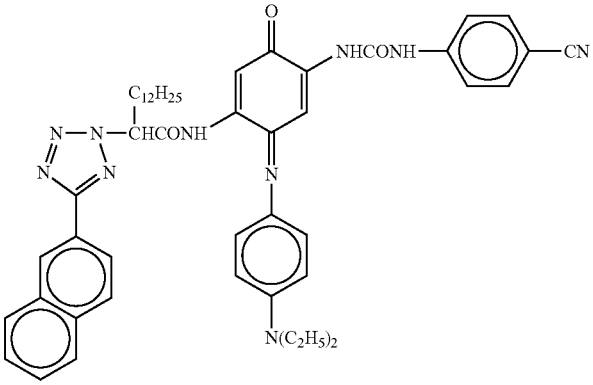
D-16
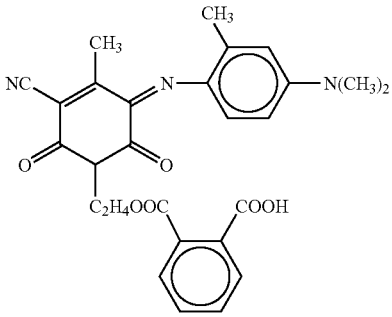
D-17
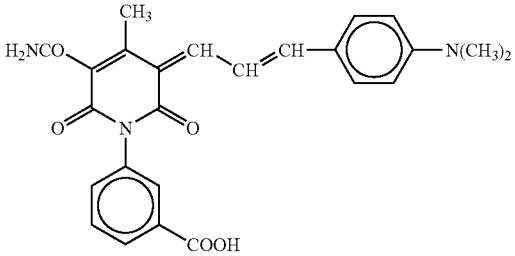
D-18
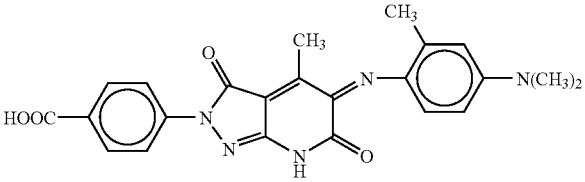
D-19
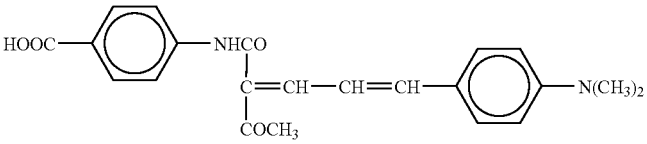
D-20
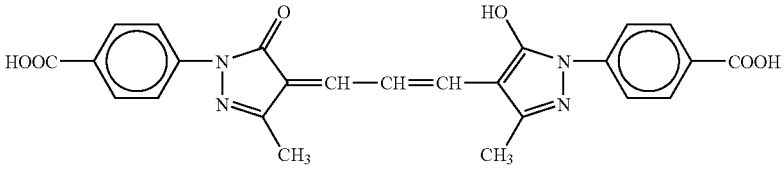
D-21
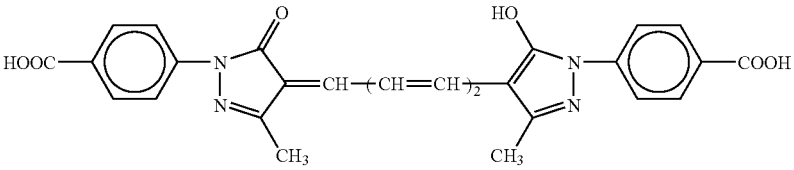
D-22
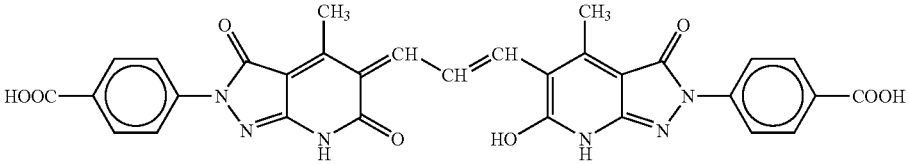

-continued
D-23
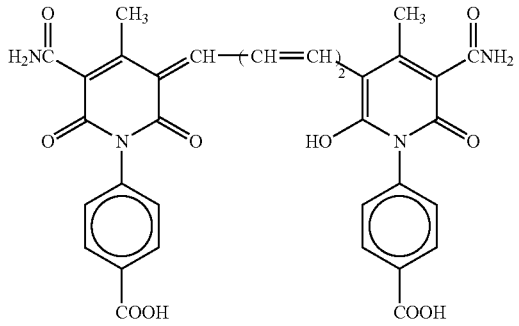
D-24
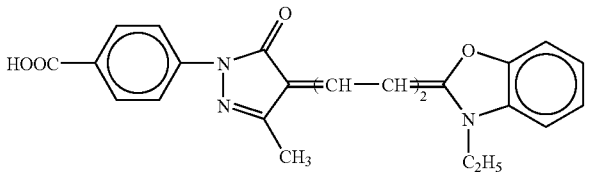
D-25
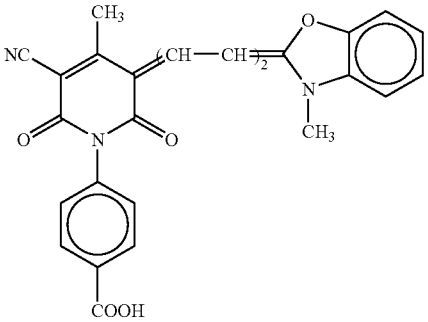
D-26
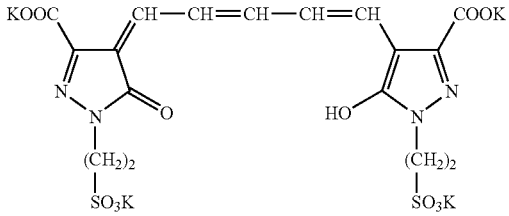
D-27
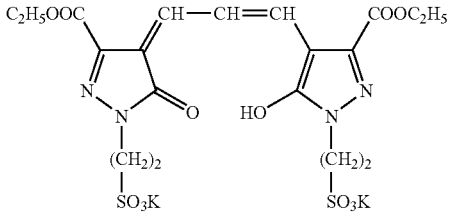
D-28
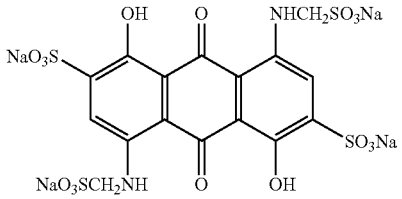
D-29
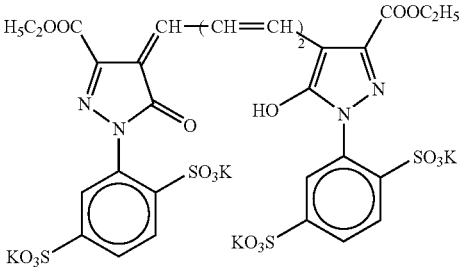
D-30
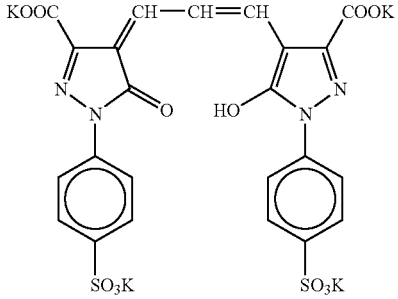
D-31
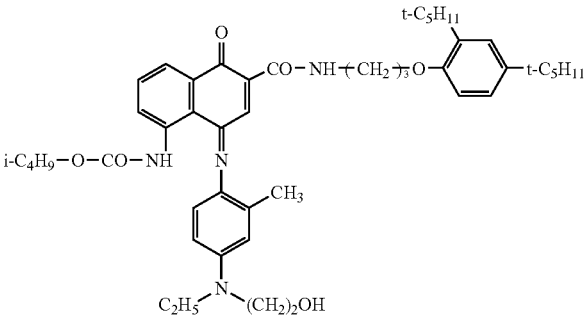
D-32
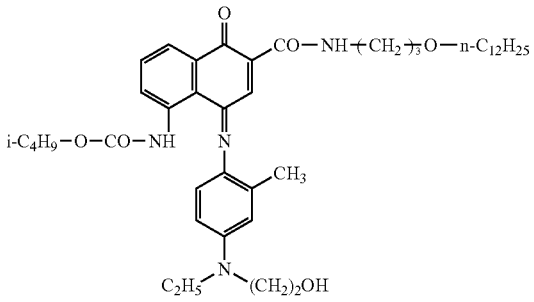
The above exemplification compounds can be synthesized by the methods described in, or according to the methods described in JP-A-61-48854, JP-A-61-7838, JP-A-60-243654, JP-A-60-32851, JP-A-62-276539 and JP-A-52-

92716, the brochure of International Patent (Unexamined) No. 88/04794, and JP-A-3-7931, JP-A-4-45436 and JP-A-5-43809.

The polymer (may be either of a homopolymer or a hetero polymer) of the polymer latex of the invention includes preferably a repeating monomer unit of 2-hydroxyphenylbenzotriazole, in particular, a unit indicated by the following formula (I):

Formula (I)

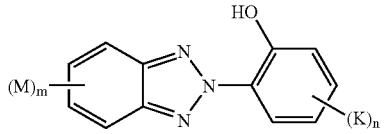

wherein a phenyl ring and a benzo ring may be further optionally substituted in accordance with requirement, either of m or n is 1 and another is 0, and M and K are represented by the following formula:

Formula (II)

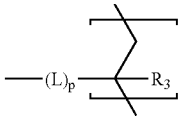

wherein R3 is H or an alkyl group (in particular, an alkyl group having 1 to 8 carbons, for example, substituted or unsubstituted methyl, ethyl or propyl), L is a divalent bonding group, and p is 0 or 1. The repeating unit in the formula (I) is preferably a unit indicated by the following formula (IA) or (IB):

(IA)

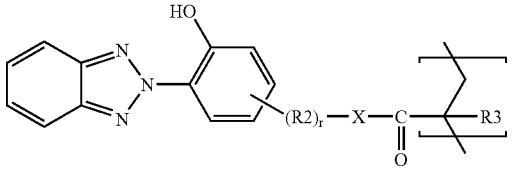

(IB)

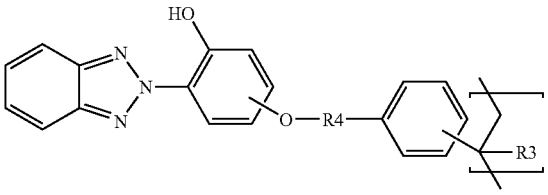

wherein X is O or NH, R2 is an alkylene group having 1 to 10 carbons, R3 is H or an alkyl group having 1 to 8 carbons, R4 is an alkylene group having 1 to 10 carbons (preferably 1), r is 0 or 1, and a phenyl ring and a benzo ring may be further optionally substituted in accordance with requirement.

In the above-mentioned formulae (IA) and (IB), R2 (IA) and the oxygen of —O—R4- (IB) can be bonded with 3-positon or 4-position of the phenyl ring (a position to which benzotriazole of the phenyl ring is bonded is referred to as 1-position). The repeating unit in the formula (IA) can be a unit indicated by the following formula (IA'), and the repeating unit in the formula (IB) can be a unit indicated by the following formula (IB'):

(IA')

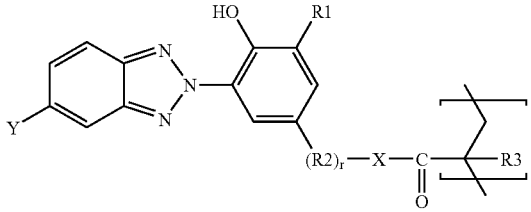

(IB')

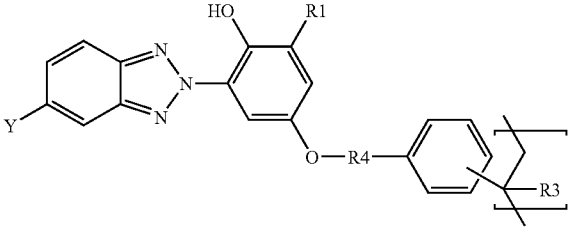

wherein R1 is selected from a group consisting of H, halogen, an alkoxy group and an alkyl group having 1 to 8 carbons, and Y is H or halogen (for example, chlorine, fluorine or bromine). R2, R3, R4, X and r are the same meaning as the respective ones in the formulae (IA) and (IB).

One example of the specific ultraviolet absorptive polymer latex which can be used for the photographic element of the present invention is mentioned as the formulae P-1 to P-20.

P-1

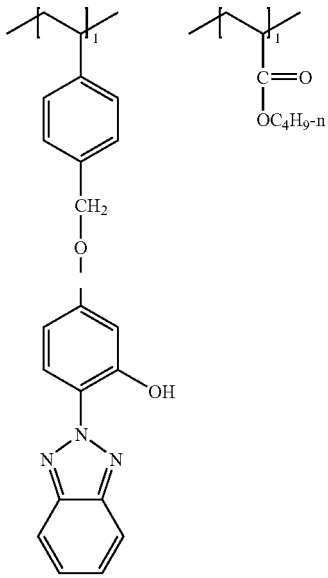

-continued
P-2
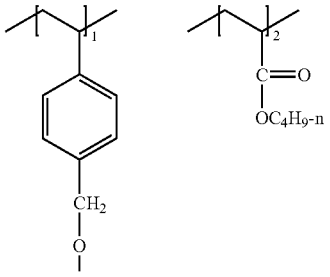
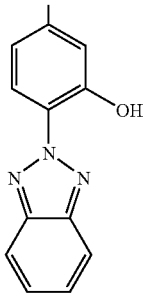
P-3
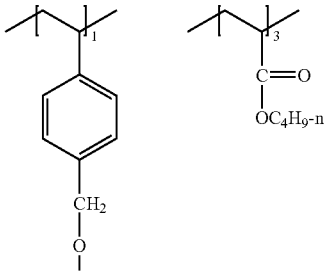
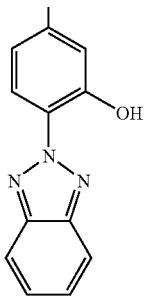
P-4
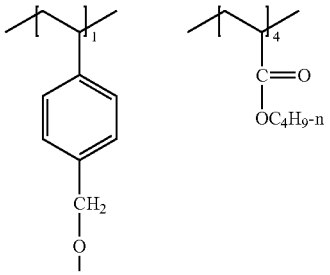
-continued
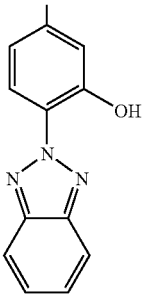
P-5
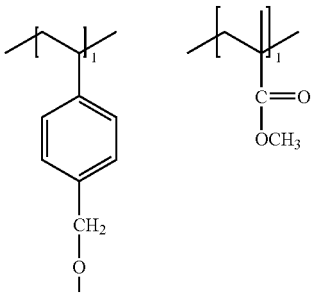
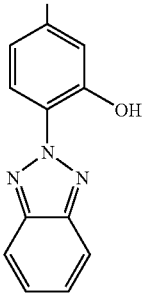
P-6
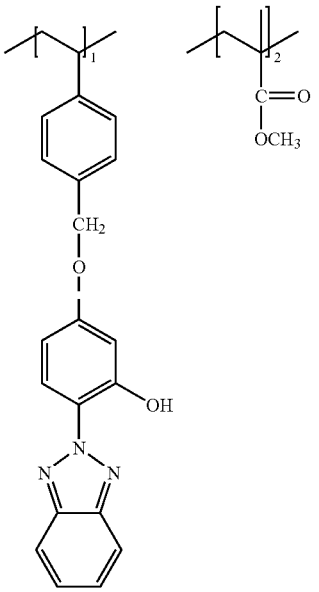

-continued
P-7
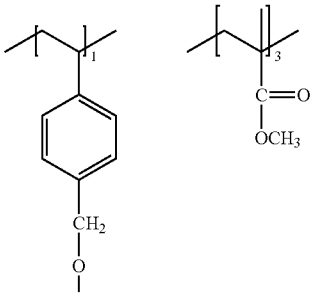
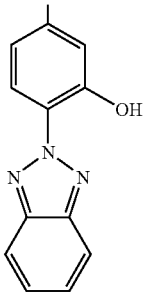
P-8
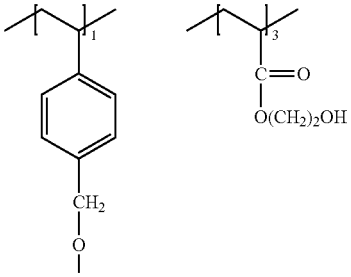
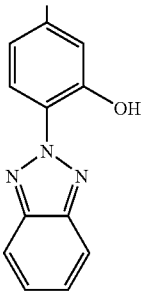
P-9
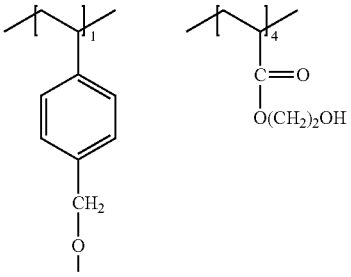
-continued
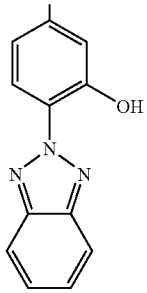
P-10
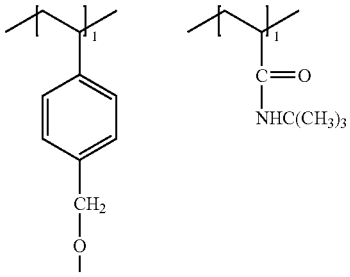
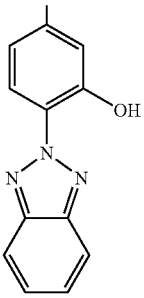
P-11
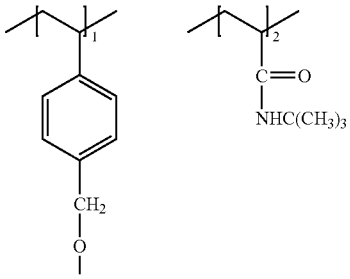
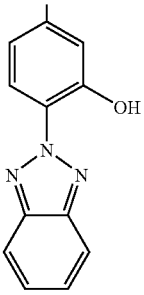

-continued
P-12
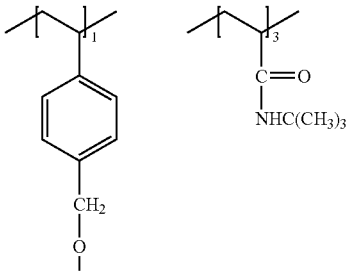
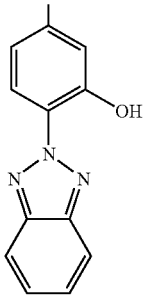
P-13
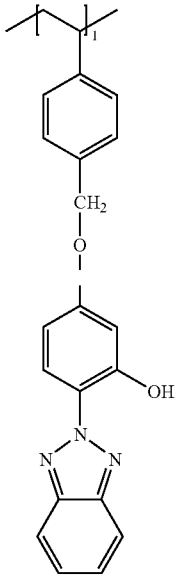
P-14
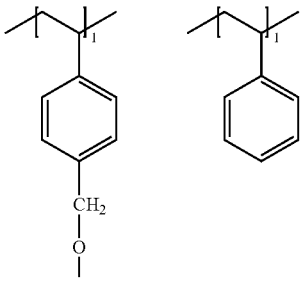
-continued
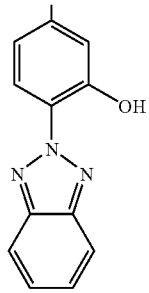
P-15
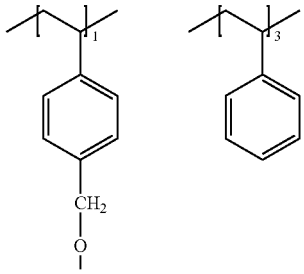
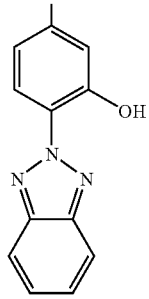
P-16
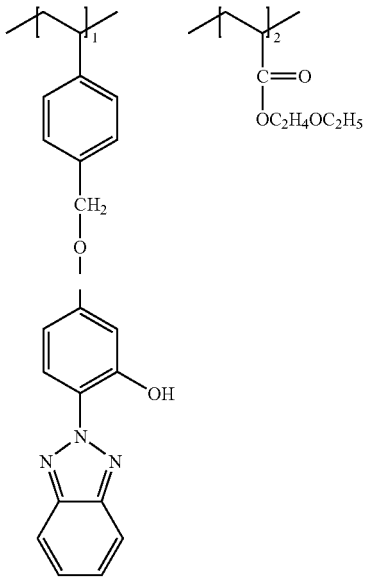

-continued
P-17
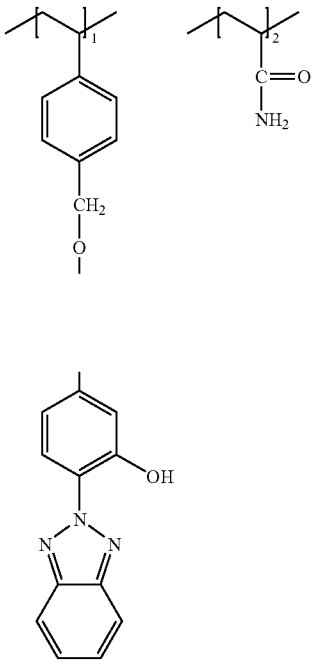
P-18
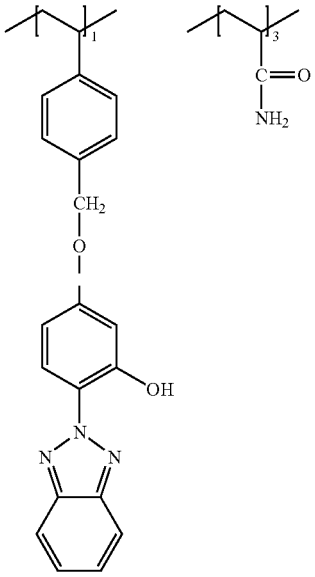
P-19
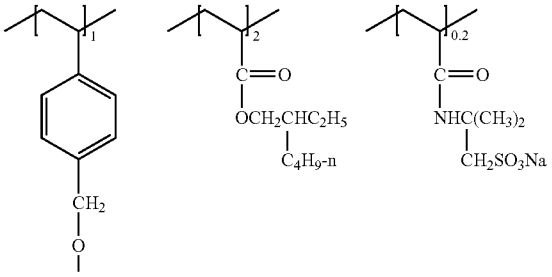
-continued
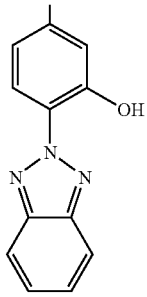
P-20
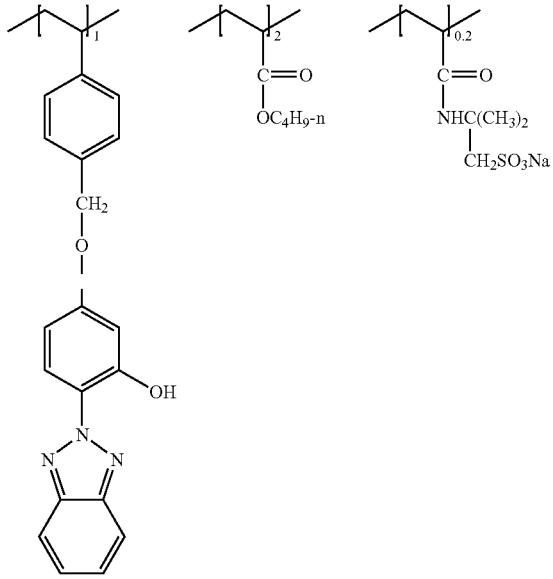
As an alternative example of the ultraviolet absorptive polymer latex, a homopolymer or a copolymer prepared from the following monomers M-1 to M-10 can be mentioned.
M-1
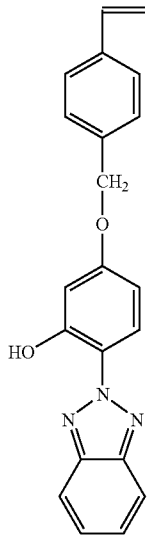

-continued

M-2

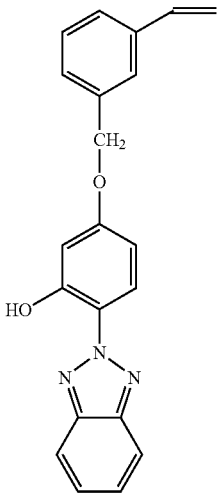

M-3

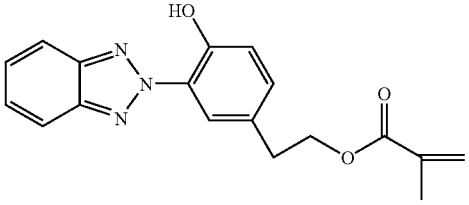

M-4

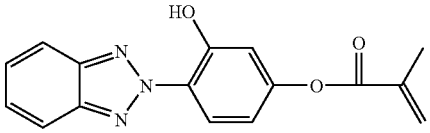

M-5

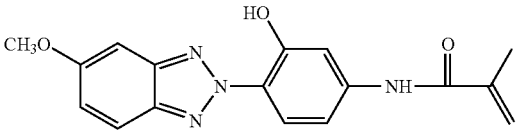

M-6

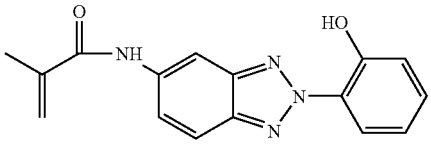

M-7

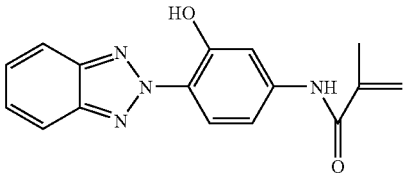

M-8

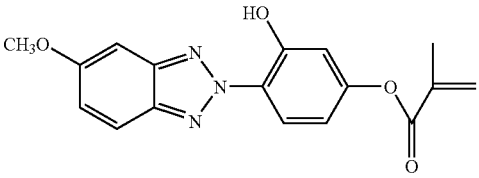

-continued

M9

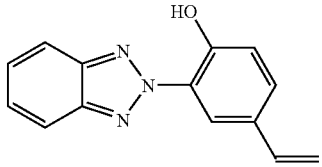

M-10

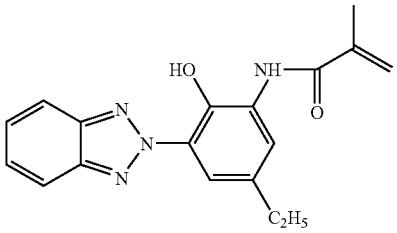

The impregnated polymer dispersion solution is introduced to the photographic element by an amount of 0.01 $g/m^2$ to 5 $g/m^2$ and preferably 0.10 $g/m^2$ to 2.0 $g/m^2$. Further, the mass ratio of a non high molecular weight ultraviolet absorbent which is impregnated in the ultraviolet absorptive polymer latex to the ultraviolet absorptive polymer latex is a range of 1:99 to 99:1, and preferably 1:9 to 9:1.

The non high molecular weight ultraviolet absorbent which can be impregnated in the ultraviolet absorptive polymer of the photographic element of the present invention can include all compounds which have a molecular weight of 10000 or less and absorption at a range of 250 nm to 450 nm (more preferably 300 nm to 400 nm). The specific example of the non high molecular weight ultraviolet absorptive compound is shown below, but the present invention is not limited thereto.

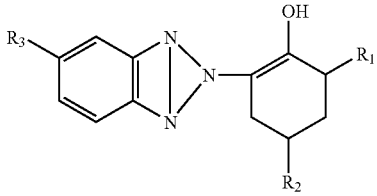

| UV No. | $R_3$ | $R_1$ | RHD 2 |
|---|---|---|---|
| UV-1 | H | H | —$C_4H_9$ (t) |
| UV-2 | H | H | —$C_{12}H_{25}$ (n) |
| UV-3 | H | H | —$CH_2CH_2COOC_8H_{17}$ |
| UV-4 | Cl | H | —$C_5H_{11}$(t) |
| UV-5 | Cl | H | —$CH_2CH_2COOC_8H_{17}$ |
| UV-6 | H | —$C_4H_9$ (sec) | —$C_4H_9$ (t) |
| UV-7 | H | —$C_5H_{11}$ (t) | —$C_5H_{11}$ (t) |
| UV-8 | H | —$C_4H_9$ (t) | —$CH_2CH_2COOC_8H_{17}$ |
| UV-9 | H | —$CH_3$ | —$C_4H_9$ (t) |
| UV-10 | Cl | —$C_4H_9$ (t) | —$C_4H_9$ (t) |
| UV-11 | Cl | —$C_4H_9$ (sec) | —$C_4H_9$ (t) |
| UV-12 | Cl | —$C_4H_9$ (t) | —$CH_2CH_2COOC_8H_{17}$ |
| UV-13 | —$OCH_3$ | —$C_4H_9$ (sec) | —$C_4H_9$ (t) |
| UV-14 | —$C_4H_9$ (sec) | —$C_4H_9$ (t) | —$CH_2CH_2COOC_8H_{17}$ |
| UV-15 | $C_6H_5$ | —$C_5H_{11}$ (t) | —$C_5H_{11}$ (t) |
| UV-16 | H | —$CH_3$ | —$CHCH_3C_{10}H_{21}$ |

-continued

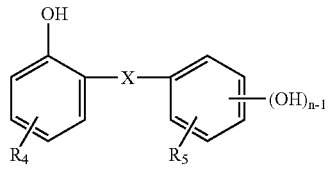

| UV No. | X | $R_4$ | $R_5$ | n-(OH) |
|---|---|---|---|---|
| UV-17 | —CO— | 5-$OC_4H_9$ | H | 1 |
| UV-18 | —CO— | 5-$OC_8H_{17}$ | H | 1 |
| UV-19 | —CO— | 5-$OC_{16}H_{33}$ | H | 1 |
| UV-20 | —CO— | 5-$OC_{18}H_{37}$ | H | 1 |
| UV-21 | —CO— | 4-$OC_4H_9$ | 4'-$OCH_3$ | 3 2'-, 5'- |
| UV-22 | —CO— | 5-$COCH_3$ | 3'-$C_8H_{17}$ | 3 2'-, 6'- |
| UV-23 | —CO— | 5-$C_{12}H_{25}$ | 4'-$COCH_3$ | 2 2'-, |
| UV-24 | —CO— | 5-$COCH_3$ | 3'-$C_8H_{17}$ | 3 2'-, 6'- |
| Uv-25 | —CO— | 4-$OC_{12}H_{25}$ | 4'-$OCH_2C_6H_4$-(p)$CH_3$ | 2 2'-, |
| UV-26 | —CO— | 5-$C_8H_{17}$ | 4'-$COC_6H_4$-(p)$CH_3$ | 3 2'-, 6'- |
| UV-27 | —COO— | 4-$C_{12}H_{25}$ | 4'-$C_4H_9$ (t) | 1 |
| UV-28 | —COO— | H | 4'-$C_4H_9$(t) | 1 |
| UV-29 | —COO— | 4-$OC_{12}H_{25}$ | 5'-$OCH_3$ | 2 2'- |
| UV-30 | —COO— | 3-$OCH_3$ | 5'-$OC_{12}H_{25}$ | 2 2'- |

UV-31

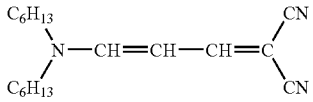

UV-32

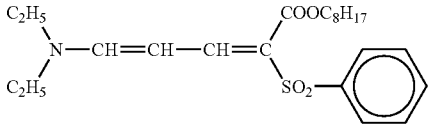

UV-33

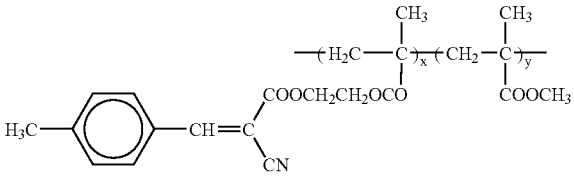

(x/y = 7/3 mass ratio)

UV-34

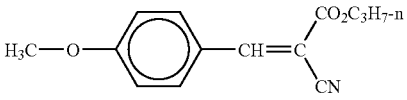

-continued

UV-35

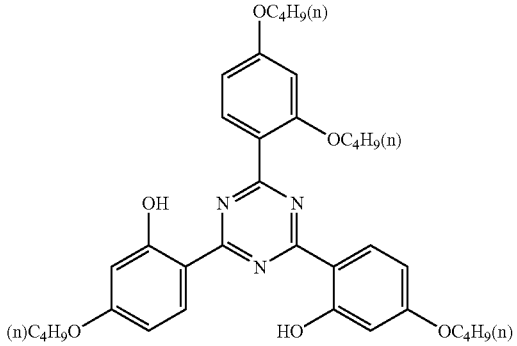

The photographic performance can be changed by compounding a high boiling organic solvent in the high molecular weight ultraviolet absorbent in the photographic element of the present invention. Examples of the high boiling organic solvent include tricresyl phosphate, di-n-butyl phthalate, N-n-amyl phthalimide, bis(2-methoxyethyl) phthalate, dimethyl phthalate, ethyl N,N-di-n-butylcarbamidate, diethyl phthalate, n-butyl 2-methoxybenzoate, 2-(n-butylethyl) phthalate, ethyl benzylmalonate, n-amyl phthalate, n-hexyl benzoate, guaiacol acetate, tri-m-crezyl phosphate, diethyl sebacate, di-isoamyl phthalate, ethyl phenylacetate, phorone, di-n-butyl sebacate, dimethyl sebacate, N,N-diethyl lauramide, N,N-di-n-butyl lauramide, phenethyl benzoate, benzyl benzoate, dioctyl phthalate, dioctyl sebacate, quinitol bis(2-ethylhexoate), cresyl diphenyl phosphate, butylcyclohexyl phthalate, tetrahydrofurfuryl adipate, tetrahydrofurfuryl benzoate, tetrahydrofurfuryl propionate, tetrahydrofurfuryl palmitate, guaiacol n-caproate, bis(tetrahydrofurfuryl) phthalate, N,N-diethylcapramide, 2,4-di-t-amylphenol, 1-laurylpyperidine, N-n-butylacetoanilide, N,N,N',N'-tetraehtylphthalamide, N-n-amylsuccinimide, diethyl citrate, 2,4-di-n-amylphenol, 1,4-cyclohexyldimethylenebis(2-ethyl hexanoate), benzylbutyl phthalate, p-dodecylphenol, trihexyl phosphate, isopropyl palmitate, bis(2-ethylhexyl)sulfoxide and the like.

When the photographic element of the present invention is produced, the polymer latex can be also prepared by any one of the following known three methods. A first method is an emulsion polymerization method. The emulsion polymerization method is well known and described in "Emulsion Polymerization" (F. A. Bovey, 1955) published by Interscience Inc., New York. Examples of the chemical initiator which can be used include a salt of persulfuric acid (for example, ammonium persulfate, potassium persulfate etc.), hydrogen peroxide, 4,4'-azobis(4-cyanovalelic acid), and a redox initiator, for example, hydrogen peroxide-iron (III) salt, potassium persulfate-sodium hydrosulfate, cerium salt-alcohol and the like. An emulsifier which can be used for emulsion polymerization includes a soap, a salt of sulfonic acid (for example, sodium N-methyl-N-oleyl taurate, etc.), a salt of sulfuric acid (for example, sodium dodecylsulfate etc.), a cationic compound (for example, hexadecyltrimethylammonium bromide etc.), an amphoteric compound, and a high molecular weight protective colloid (for example, a polyvinyl alcohol, a polyacrylic acid, gelatin etc.). Specific examples and action of the emulsifier are described in "Belgische Chemische Industrie" (Vol. 28, pages 16 to 20, 1963).

The emulsion polymerization of a water-insoluble solid ultraviolet absorptive monomer is usually carried out in a water system or a water/organic solvent system. The usable organic solvent is preferably a solvent which is high miscibility with water, substantially inactive for the monomer used and does not obstruct a usual reaction in radical addition polymerization. Preferable examples include an alcohol having 1 to 4 carbons (for example, methanol, ethanol, isopropanol etc.), a ketone (for example, acetone etc.), a cyclic ether (for example, tetrahydrofuran etc.), a nitrile (for example, acetonitrile etc.), an amide (for example, N,N-dimethylformamide etc.), a sulfoxide (for example, dimethylsulfoxide), and the like. The method is the most direct method of preparing a polymer latex, and described in the specifications of U.S. Pat. No. 4,464,462 and U.S. Pat. No. 4,455,368, and European Patent Application Publication (Unexamined) No. 190,003 (1991).

A second method of preparing the polymer latex of the ultraviolet absorbent, for producing the photographic element of the present invention, is a solution polymerization method for a monomer mixture including the ultraviolet absorptive monomer (I), a comonomer and an ionic comonomer containing sulfonic acid, sulfuric acid, carboxylic acid or a phosphoric acid group. The preferable ionic comonomer includes acrylamido-2,2'-dimethylpropanesulfonic acid, 2-sulfoethyl methacrylate or sodium styrene sulfonate. Examples of the chemical initiator commonly used include an azo type initiator (for example, 2,2'-azobisisobutyronitrile, dimethyl-2,2'-azobisisobutylate, 4,4'-azobis(4-cyanovalelic acid) etc.) and a peroxide type initiator (for example, benzoyl peroxide, lauroyl peroxide etc.). Then, the polymer solution obtained is dispersed in an aqueous solution which contains another surfactant or not, to form a latex.

A third method of preparing the polymer latex of the ultraviolet absorbent, for producing the photographic element of the present invention, is a method of carrying out the solution polymerization of a monomer mixture including the ultraviolet absorptive monomer (I) and another comonomer. As described in the specification of U.S. Pat. No. 4,455,368 (1984), it prepares a latex by dissolving a hydrophobic high molecular weight ultraviolet absorbent using an organic solvent and dispersing the solution in a gelatin aqueous solution. The solvent is removed from the mixture before coating the dispersion solution, or removed by evaporation at drying the dispersion solution coated, but the former is preferable. The usable solvent includes a solvent having a certain degree of water-solubility by which it can be removed by rinsing with water in a gelatin noodle condition, and a solvent which can be removed by spray drying, reduced pressure or steam purge. Examples of the solvent which can be removed include an ester (for example, ethyl acetate), a lower alkyl ether, a ketone, a halogenated hydrocarbon, an alcohol and a mixture thereof. Any kind of the dispersing agents can be used for the dispersion solution of the hydrophobic high molecular weight ultraviolet absorbent. However, an ionic surfactant, in particular, an anionic surfactant is preferable. A small amount of a high boiling organic solvent such as, for example, dibutyl phthalate, tricresyl phosphate, p-dodecylphenol and 1,4-cyclohexyldimethylenebis(2-ethylhexanoate) can be added for improving the photographic performance of the high molecular weight ultraviolet absorbent, if necessary. It is preferable to keep good sharpness by suppressing the thickness of the final emulsion layer or the hydrophilic colloid layer by using the amount as little as possible.

With respect to the method of impregnating a non high molecular weight ultraviolet absorbent or another compound in a polymer latex, for example, an "impregnation method" for a polymer latex is generally described in the specification of U.S. Pat. No. 4,199,363. There are several methods of impregnating a polymer latex. In a first method, an aqueous dispersion solution of a non high molecular weight ultraviolet absorbent and another compound (or a mixture of the compounds) is prepared in the presence of gelatin by a usual colloid mill method. Then, the dispersion solution and the polymer latex are blended so that the mass ratio of the non high molecular weight ultraviolet absorbent to the polymer latex is a range of 1:99 to 99:1, and more preferably 1:9 to 9:1.

A second method impregnates a non high molecular weight ultraviolet absorbent in a high molecular weight ultraviolet absorbent in the presence of a low boiling organic solvent such as methanol and acetone. Then, the auxiliary solvent is evaporated with a rotary evaporator. With respect to the mass ratio of the non high molecular weight ultraviolet absorbent to the high molecular weight ultraviolet absorbent, the same mass ratio as that adopted in the first method can be also adopted.

The method of impregnating the polymer latex is described in, for example, the specifications of U.S. Pat. No. 4,203,716, U.S. Pat. No. 4,214,047, U.S. Pat. No. 4,247,627, U.S. Pat. No. 4,497,929 and U.S. Pat. No. 4,608,424.

The tabular silver halide grains used in the present invention is specifically illustrated below. The tabular silver halide grain is a generic name of silver halide grains having one twin plane or two or more parallel twin planes. The twin plane means a plane when ions at all lattice points are mirror image relation at both sides of the plane. When grains are viewed from an upper side, the tabular grains are triangular shapes, hexagonal shapes or circular shapes in which these wore roundness. The triangular shapes have triangular outer faces, the hexagonal shapes have hexagonal outer faces, and the circular shapes have circular mutually parallel outer faces.

In the present invention, the average aspect ratio of the tabular grains is obtained as the average value of aspect ratios of the respective grains when the thicknesses of grains are less than 0.5 μm. Values (aspect ratios) obtained by dividing the respective equivalent-circular diameters by the thicknesses are determined with respect to the tabular grains having equivalent-circular diameters with 0.3 μm or more, and respective projected areas are added in order from grains having a larger aspect ratio and all projected areas reach at a fixed proportion (for example, 50%). The measurement of the thicknesses of grains can be easily carried out by evaporating a metal from the oblique direction of grains together with a latex for reference, measuring the lengths of the shadows on electron microscope photographs and calculating them referring to the shadow lengths of the latex. The equivalent-circular diameter in the present invention is the diameter of a circle an area equal to the projected area of the parallel outer surface of a grain. The projected area of a grain is obtained by measuring the area of a grain on the electron microscope photograph and correcting the photographing magnification. The diameter of the tabular grains is preferably 0.3 to 5.0 μm. The thickness of the tabular grains is preferably 0.05 to 0.5 μm.

Further, when mono-dispersed tabular grains are used, further preferable result is occasionally obtained. In the structure and production method of the mono-dispersed tabular grains, according to the description in, for example, JP-A-63-151618 and the like, the shape is simply described. 70% or more of the total projected areas of the silver halide grains are hexagonal shapes in which the ratio of the length of a side having the maximum length to the length of a side having the minimum length is 2 or more, and have mono-dispersibility in which the fluctuation coefficient [a value obtained by multiplying 100 to a value obtained by dividing the deviation (standard deviation) of grain sizes represented by the equivalent-circular diameters of the projected areas, by average size] of the grain size distribution of the hexagonal tabular silver halide grains is 20% or less.

The process of preparing the tabular grain used in the present invention is described next. The tabular grains used in the present invention can be prepared by improving methods described in, e.g., "Cleave, Photography Theory and Practice (1930), page 13", "Gutuff, Photographic Science and Engineering Vol. 14, pages 248–257 (1970)", and specifications of U.S. Pat. Nos. 4,434,226, 4,414,310, 4,433,048 and 4,439,520, and GB 2,112,157.

Any of the silver halides such as silver bromide, silver iodobromide, silver iodochlorobromide and silver chlorobromide may be used for the tabular silver halide grains used in the present invention. The preferable silver halide is silver iodobromide or silver iodochlorobromide, containing 30 mol % or less of silver iodide.

Further, the silver halide emulsion of the present invention may have a double or multiple structure with respect to the halogen composition in grains. The dislocations of the tabular grains of the present invention are introduced by providing high iodine phases in the inside of grains. The high iodine phase is an iodine-containing silver halide solid solution. In this case, as the silver halide, silver iodide, silver iodobromide and silver chloroiodobromide are preferable, silver iodide or silver iodobromide is more preferable, and silver iodide is particularly preferable. The amount of the silver halide as silver is 30% by mol or less of the amount of silver of the total grains and more preferably 10% by mol or less. The phase which is grown on the outside of the high iodine phase is required to have a lower iodine content than the iodine content of the high iodine phase, and the iodine content is preferably 0 to 12% by mol, more preferably 0 to 6% by mol, and most preferably 0 to 3% by mol.

The aspect ratio of the tabular silver halide grains which occupy 50% or more of the total projected areas of the silver halide grains which are preferably used for the blue-sensitive silver halide emulsion layer separated farthest from a support is 3 or more, more preferably 4 to 10, and further preferably 5 and less than 8.

Further, when mono-dispersed tabular grains having a narrow grain size distribution are used, further preferable result is occasionally obtained. The methods of producing mono-dispersed hexagonal tabular grains having a high tabular rate are described in the specification of U.S. Pat. No. 4,797,354 and JP-A-2-838. Further, a method of producing tabular grains having the fluctuation coefficient of the grain size distribution of less than 10% using a polyalkylene oxide block copolymer is described in the specification of European Patent 514,742. It is preferable to use these tabular grains in the present invention. Further, grains having high uniformity in the thicknesses in which the fluctuation coefficient of the grain thicknesses is 30% or less are also further preferable.

It is important to select thickness of grains considering the wavelength of incident light in the photosensitive material or light which sensitizes the grains, in order to improve sharpness. It is preferable to arrange grains having a thickness of 0.08 to 0.10 μm for a layer scattering blue light with 400 to 500 nm or a layer which is sensitized to the blue light. A thickness of 0.19 to 0.21 μm is preferable. It is preferable to arrange grains having a thickness of 0.11 to 0.13 μm for a layer scattering green light with 500 to 600 nm or a layer which is sensitized to the green light. Then, a thickness of 0.23 to 0.25 μm is preferable. It is preferable to arrange grains having a thickness of 0.14 to 0.17 μm for a layer scattering red light with 600 to 700 nm or a layer which is sensitized to the red light. Then, a thickness of 0.28 to 0.30 μm is preferable. It is preferable to arrange grains having a thickness of 0.17 to 0.19 μm for a layer scattering infrared light or a layer which is sensitized to infrared light. When one photosensitive layer consists of a plurality of photosensitive layers having different sensitivities, it is best to arrange grains having preferable thickness to all layers. Then, it is preferable to arrange grains at a photosensitive layer which is far from a support. It is preferable in particular to use grains with a thickness preferable for the respective photosensitive layers in combination. For example, grains with a thickness preferable for both of the blue-sensitive photosensitive layer and the red-sensitive photosensitive layer are arranged. Either combination of the blue-sensitive photosensitive layer, the green-sensitive photosensitive layer and the red-sensitive photosensitive layer can be also selected.

The silver halide color photosensitive material of the present invention is only required to have at least one red-sensitive silver halide emulsion layer, at least one green-sensitive silver halide emulsion layer, and at least one blue-sensitive silver halide emulsion layer in order from the side near a support. Typical example thereof is a silver halide photosensitive material having a red-sensitive emulsion layer unit, a green-sensitive emulsion layer unit and a blue-sensitive emulsion layer unit each having color sensitivity to red light, green light and red light respectively in which each of the red-sensitive emulsion layer unit, green-sensitive emulsion layer unit and blue-sensitive emulsion layer unit comprises a plural of silver halide emulsion layers each having the substantially the same color sensitivity but different in speed. In the present invention, the arrangement of the sensitive layer unit is in the order, from a support, of a red-sensitive emulsion layer unit, a green-sensitive emulsion layer unit and a blue-sensitive emulsion layer unit.

A non lightsensitive layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744 and 4,707,436 and JP-A's-62-160448 and 63-89850 is preferably arranged adjacent to or close to the main lightsensitive layers.

The silver halide preferably used in the present invention is silver iodobromide, silver iodochloride, or silver iodochlorobromide containing about 30 mol % or less of silver iodide. A particularly preferable silver halide is silver iodebromide or silver iodochlorobromide containing about 2 to about 10 mol % of silver iodide. Silver halide grains contained in the photographic emulsion can have regular crystals such as cubic, octahedral, or tetradecahedral crystals, irregular crystals such as spherical or tabular crystals, crystals having crystal defects such as twin planes, or composite shapes thereof. The silver halide grain can be a fine grain having a grain size of about 0.2 μm or less, or be a large grain having a projected area diameter of up to about 10 μm, and an emulsion can be either a polydisperse or monodisperse emulsion. A silver halide photographic emulsion which can be used in the present invention can be prepared by methods described in, e.g., "I. Emulsion preparation and types," Research Disclosure (RD) No. 17643 (December, 1978), pp. 22 and 23, and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable. Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB 2,112,157. A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or lead oxide can be bonded. A mixture of grains having various types of crystal shapes can also be used. The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, and they are summarized in a table to be presented later.

In a photosensitive material of the present invention, it is possible to mix, in a single layer, two or more types of emulsions different in at least one of characteristics of a photosensitive silver halide emulsion, i.e., a grain size, grain size distribution, halogen composition, grain shape, and speed.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-image-wise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

It is preferable in the invention to use a technology of improving a light absorptive coefficient with a spectral sensitizing dye in combination. For example, the sensitizing dye is adsorbed on the surface of the silver halide grains by a much more amount than a saturated coating amount, by utilizing intermolecular force, and dyes in which two or more dye coloring groups not conjugated are linked by a covalent bonding, namely so-called linked dyes are adsorbed on the silver halide grains. For example, they are described in the patents shown below.

JP-A-10-239789, JP-A-11-133531, JP-A-2000-267216, JP-A-2000-275772, JP-A-2001-75222, JP-A-2001-75247, JP-A-2001-75221, JP-A-2001-75226, JP-A-2001-75223,

JP-A-2001-255615, JP-A-2002-23294, JP-A-10-171058, JP-A-10-186559, JP-A-10-197980, JP-A-2000-81678, JP-A-2001-5132, JP-A-2001-166413, JP-A-2002-49113, JP-A-64-91134, JP-A-10-110107, JP-A-10-171058, JP-A-10-226758, JP-A-10-307358, JP-A-10-307359, JP-A-10-310715, JP-A-2000-231174, JP-A-2000-231172, JP-A-2000-231173, JP-A-2001-356442, European Patent Nos. 985,965A, 985,964A, 985,966A, 985,967A, 1,085,372A, 1,085,373A, 1,172,688A, 1,199,595A and 887,700A1.

Further, it is preferable to use technologies described in JP-A-10-239789, JP-A-2001-75222 and JP-A-10-171058 in combination.

In the present invention, it is preferable to use a nonsensitive fine grain silver halide. The nonsensitive fine grain silver halide consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circular diameters of projected areas) of the fine grain silver halide is preferably 0.01 to 0.5 μm, and more preferably, 0.02 to 0.2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a photosensitive material of the present invention is preferably 6.0 g/m$^2$ or less, most preferably 4.5 g/m$^2$.

It is also preferred that the photosensitive material of the present invention contain "a compound which undergoes a one-electron oxidation so as to form a one-electron oxidation product capable of releasing one or more electrons".

This compound is preferably selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2003-33446) among the compounds of inducing the reaction represented by the chemical reaction formula (1) (identical with the chemical reaction formula (1) described in JP-A-2004-245929). Preferred ranges of these compounds are the same as described in the cited patent specifications.

General formula (1)

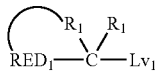

General formula (2)

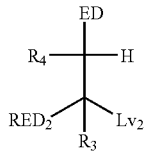

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group. ED represents an electron donating group.

General formula (3)

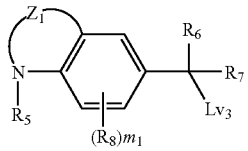

-continued

General formula (4)

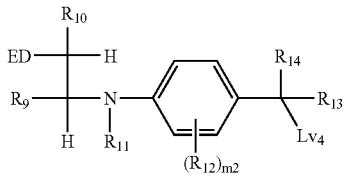

General formula (5)

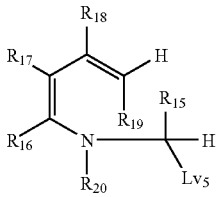

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

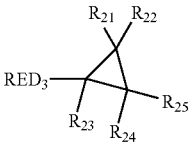

General formula (7)

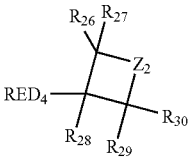

In the general formulae (6) and (7), each of $RED_3$ and $RED_4$ represents a reducing group. Each of $R_{21}$ to $R_{30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

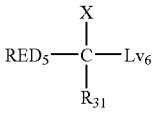

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

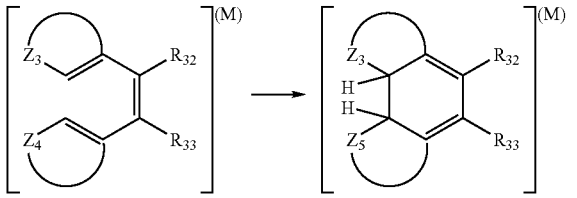

General formula (9)

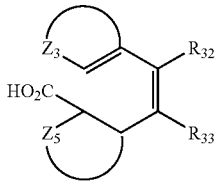

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{32}$, $R_{33}$ and $Z_3$ have the same meaning as in the chemical reaction formula (1). $Z_5$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

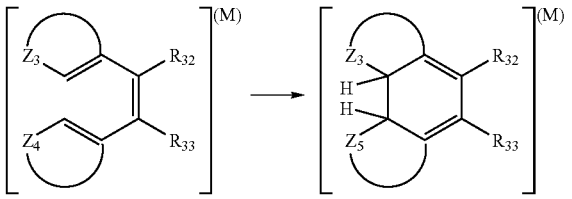

General formula (11)

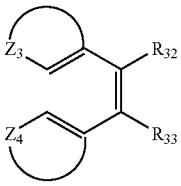

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. $Z_5$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{-}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

Photographic additives usable in the present invention are also described in RD's, the disclosures of which are incorporated herein by reference, and the relevant portions are summarized in the following table.

| | Types of Additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879. |

Various dye forming couplers can be used in the photosensitive material of the present invention, and the following couplers are particularly preferable.

Yellow couplers: couplers represented by formulae (I) and (II) in EP No. 502,424A; couplers represented by formulae (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulae (II) to (IV) in column 7, lines 36 to 58, in U.S. Pat. No. 4,476,219 (particularly II-17, II-19 (column 17), and II-24 (column 19)), the disclosures of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulae (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

As the coupler by which the sensitizing dye has appropriate dispersibility, couplers described in the respective specifications of U.S. Pat. No. 4,366,237, GB 2,125,570, EP 96,873B and DE 3,234,533 are preferable.

The coupler for correcting the unnecessary absorption of the sensitizing dye is preferably yellow colored cyan couplers represented by the formulae (CI), (CII), (CIII) and (CIV) which are described in page 5 of the specification of European Patent No. 456,257A1 (in particular, YC-86 of page 84), yellow colored magenta couplers ExM-7 (page 202), EX-1 (page 249) and EX-7 (page 251) which are described in the specification of the European Patent, magenta colored cyan couplers CC-9 (column 8) and CC-13 (column 10) in the specification of U.S. Pat. No. 4,833,069, and a colorless masking coupler described in (2) (column 8) of the specification of U.S. Pat. No. 4,837,136 and represented by the formula (A) of claim 1 which is described in the brochure of International Patent (Unexamined) WO92/11575 (the exemplification compound in pages 36 to 45, in particular).

As the compound (including the coupler) releasing a compound residual group which is photographically useful in reaction with the color developing agent oxidized form, the following is mentioned. Development inhibitor release compounds: compounds represented by formulae (I), (II), (III), and (IV) on page 11 of the specification of European Patent Application No. 378,236A1 (particularly T-101 (page 30), T-104 (page 31), T-113 (page 36), T-131 (page 45), T-144 (page 51), and T-158 (page 58)); a compound represented by the formula (I) on page 7 of the specification of European Patent No. 436,938A2 (particularly D-49 (page 51)); a compound represented by the formula (1) in the specification of European Patent No. 568,037A (particularly (23) (page 11)); and compounds represented by formulae (I), (II), and (III) on pages 5 and 6 of the specification of European Patent No. 440,195A2 (particularly I-(1) on page 29). Bleaching accelerator release compounds: compounds represented by the formulae (I) and (I') on page 5 of the specification of European Patent No. 310,125A2 (particularly (60) and (61) on page 1); and compounds represented by the formula (I) in claim 1 of JP-A-6-59411 (particularly (7) (page 7)). Ligand release compounds: compounds represented by LIG-X described in claim 1 of the specification of U.S. Pat. No. 4,555,478 (particularly compounds in column 12, lines 21 to 41). Leuco dye release compounds: compounds 1 to 6 in columns 3 to 8 of the specification of U.S. Pat. No. 4,749,641. Fluorescent dye release compounds: compounds represented by COUP-DYE in claim 1 of the specification of U.S. Pat. No. 4,774,181 (particularly compounds 1 to 11 in columns 7 to 10). Development accelerator or fogging agent release compounds: compounds represented by the formulae (1), (2), and (3) in column 3 of the specification of U.S. Pat. No. 4,656,123 (particularly (I-22) in column 25); and ExZK-2 on page 75, lines 36 to 38, in the specification of European Patent No. 450,637A2. Compounds which release a group which does not function as a dye unless it splits off: compounds represented by the formula (I) in claim 1 of the specification of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: a latex described in the specification of U.S. Pat. No. 4,199,363. Scavengers of developing agent in an oxidized form: compounds represented by the formula (I) in column 2, lines 54 to 62 of the specification of U.S. Pat. No. 4,978,606 (particularly I-(1), I-(2), I-(6), and I-(12) (columns 4 and 5)), and the formulae in column 2, lines 5 to 10 of the specification of U.S. Pat. No. 4,923,787 (particularly compound 1 (column 3)). Stain inhibitors: the formulae (I) to (III) on page 4, lines 30 to 33, particularly I-47, I-72, III-1, and III-27 (pages 24 to 48) of European Patent No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) described in the specification of European Patent No. 298, 321A; II-1 to III-23, particularly III-10, in columns 25 to 38 of the specification of U.S. Pat. No. 5,122,444; I-1 to III-4, particularly II-2, on pages 8 to 12 of the specification of European Patent No. 471,347A; and A-1 to A-48, particularly A-39 and A-42, in columns 32 to 40 of the specification of U.S. Pat. No. 5,139,931. Materials which reduce the use amount of a color enhancer or a color-mixing inhibitor: I-1 to II-15, particularly I-46, on pages 5 to 24 of the specification of European Patent No. 411,324A. Formalin scavengers: SCV-1 to SCV-28, particularly SCV-8, on pages 24 to 29 of the specification of European Patent No. 477,932A. Film hardeners: H-1, H-4, H-6, H-8, and H-14 on page 17 of JP-A-214845; compounds (H-1 to H-54) represented by the formulae (VII) to (XII) in columns 13 to 23 of the specification of U.S. Pat. No. 4,618,573; compounds (H-1 to H-76), particularly H-14, represented by the formula (6) on page 8, lower right column, in JP-A-2-214852; and compounds described in claim 1 of the specification of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of the specification of U.S. Pat. No. 5,019,492. Antiseptic agents and mildew proofing agents; I-1 to III-43, particularly II-1, II-9, II-10, II-18, and III-25, in columns 3 to 15 of the specification of U.S. Pat. No. 4,923,790. Stabilizers and antifoggants: I-1 to (14), particularly I-1, I-60, (2), and (13), in columns 6 to 16 of the specification of U.S. Pat. No. 4,923,793; and compounds 1 to 65, particularly compound 36, in columns 25 to 32 of U.S. Pat. No. 4,952,483. Chemical sensitizers: triphenylphosphine, selenide, and a compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 of JP-A-3-156450; F-I-1 to F-II-43, particularly F-I-11 and F-II-8, on pages 33 to 55 of the specification of European Patent No. 445,627A; III-1 to III-36, particularly III-1 and III-3, on pages 17 to 28 of the specification of European Patent No. 457,153A; microcrystalline dispersions of Dye-1 to Dye-124 on pages 8 to 26 in International Patent (Unexamined) WO No. 88/04794; compounds 1 to 22, particularly compound 1, on pages 6 to 11 of the specification of European Patent No. 319,999A; compounds D-1 to D-87 (pages 3 to 28) represented by formulae (1) to (3) in the specification of European Patent No. 519,306A; compounds 1 to 22 (columns 3 to 10) represented by the formula (I) in the specification of U.S. Pat. No. 4,268,622; and compounds (1) to (31) (columns 2 to 9) represented by the formula (I) in the specification of U.S. Pat. No. 4,923, 788. UV absorbents: compounds (18b) to (18r) and 101 to 427 (pages 6 to 9) represented by formula (1) in JP-A-46-3335; compounds (3) to (66) (pages 10 to 44) represented by the formula (I) and compounds HBT-1 to HBT-10 (page 14) represented by the formula (III) in the specification of European Patent No. 520,938A; and compounds (1) to (31) (columns 2 to 9) represented by the formula (1) in the specification of European Patent No. 521,823A.

The present invention can be applied to various color photosensitive materials such as color negative films for general purposes or cinemas, color reversal films for slides and TV, color paper, color positive films and color reversal paper. Moreover, the present invention is suitable to lens-equipped film units described in Jpn. Pat. Appln. KOKOKU Publication (hereinafter referred to as JP-B) No. 2-32615 and Jpn. UM Appln. KOKOKU Publication No. 3-39784. Supports which can be suitably used in the present invention are described in, for example, RD. No. 17643, page 28; RD. No. 18716, from the right column of page 647 to the left column of page 648; and RD. No. 307105, page 879. In the photosensitive material of the present invention, the total of thicknesses of all the hydrophilic colloidal layers on the side having emulsion layers is preferably 28 μm or less, more preferably 23 μm or less, further preferably 18 μm or less, and particularly preferably 16 μm or less. The film swelling speed T½ is preferably 30 sec or less, and more preferably 20 sec or less. The film swelling speed T½ is defined as the time that, when the saturation film thickness means 90% of the maximum swollen film thickness realized by the processing in a color developing solution at 30° C. for 3 min and 15 sec, spent for the film thickness to reach ½ of the saturation film thickness. The film thickness means one measured under moisture conditioning at 25° C. and at a relative humidity of 55% (two days). The film swelling speed T½ can be measured by using a swellometer described in A. Green et al., Photogr. Sci. Eng., Vol. 19, No. 2, pp. 124 to 129. The film swelling speed T½ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

$$(\text{Maximum swollen film thickness} - \text{film thickness}) / \text{film thickness}$$

In the photosensitive material of the present invention, a hydrophilic colloid layer (called as the "back layer") having a total dried film thickness of 2 to 20 μm is preferably formed on the side opposite to the side having emulsion layers. The back layer preferably contains a light absorbent, a filter dye, an ultraviolet absorbent, an antistatic agent, a film hardener, a binder, a plasticizer, a lubricant, a coating aid and surfactant. The swelling ratio of the back layers is preferably 150% to 500%.

The photosensitive material of the present invention can be developed by conventional methods described in the RD. No. 17643, pages 28 and 29; RD. No. 18716, page 651, left to right columns; and RD. No. 307105, pages 880 and 881. The color developing solution for use in development processing of the photosensitive material of the invention is preferably an aqueous alkaline solution in which an aromatic primary amine-base color developing agent is a main component. As the color developing agent, an aminophenol compound is also useful, but a p-phenylenediamine base compound is preferably used, and as its typical example and preferable example, a compound on page 28, 43 to 52 lines of the specification of European Patent No. 556700A, is mentioned. Two or more of these compounds can be used in combination in accordance with its purpose. The color developing solution contains generally a carbonic acid salt of an alkali metal, a pH buffer such as a boric acid salt or phosphoric acid salt, a salt of chloride, a salt of bromide, a salt of iodide, benzimidazoles, and benzothaizoles or a developing inhibitor such as a mercapto compound or an antifoggant. Further, if necessary, hydrazines such as hydroxylamine, diethylhydroxylamine, a sulfurous acid salt and N,N-biscarboxymethylhydrazine, various preservatives such as phenylsemicarbazides, triethanolamine and cathecolsulfonic acid; organic solvents such as ethylene glycol and diethylene glycol; developing accelerators such as benzyl alcohol, a polyethylene glycol, a quaternary ammonium and amines; auxiliary developing agents such as a dye forming coupler, a competitive coupler and 1-phenyl-3-pyrazolidone; tackiness bestowing agent, various chelate agents represented by aminopolycarboxylic acid, aminopolyphosphoric acid, alkylphosphonic acid and phosphonocarboxylic acid; for example, ethylenediaminetetraacetatic acid, nitrilotriacetatic acid, diethylenetriaminepentaacetatic acid, cyclohexanediaminetetraacetic acid, hydroxyethyliminodiacetatic acid, 1-hydroxy-ethylidene-1,1-diphosphonic acid, nitrilo-N,N,N-trimethlenephosphonic acid, ethylenediamine-N,N,N,N-tetramethylene phosphphonic acid, ethlenediamine-di(o-hydroxyphenylacetic acid) and a salt thereof are added.

Further, when reversal processing is carried out, color development is carried out after usual black and white development is carried out. In the black and white developing solution, known black and white developing agents such as dihydroxybenzenes such as hydroquinone, 3-pirazolidones such as 1-phenyl-3-pyrazolidone, or aminophenols such as N-methyl-p-aminophenol can be used alone or in combination. The pH of these color developing solutions and black and white developing solutions is generally 9 to 12. The amount of these developing solutions replenished is depending on the color photosensitive material processed, but in general, 3 liter or less per 1 square meter of the photosensitive material. It can be 500 mL or less by reducing the ionic concentration of bromide in the replenisher. When the replenishing amount is reduced, it is preferable to prevent the evaporation of the liquid and oxidation by air by lessening a contact area with air of a processing vessel. The processing effect caused by contact of air with the photograph processing solution in the processing vessel can be evaluated by opening ratio (=[contact area of processing solution with air $cm^2$]/[volume of processing solution $cm^3$]). The opening ratio is preferably 0.1 or less and more preferably 0.001 to 0.05. A method of reducing the opening ratio includes a method of using a movable lid described in JP-A-1-82033, a method of processing slit development described in JP-A-63-216050 in addition to a method of providing a shielding article such as a floating lid on the surface of the photographic processing solution of the processing vessel. It is preferable to reduce the opening ratio not only in both steps of the color developing and black and white developing, but also in all steps such as successive steps such as, for example, bleaching, bleaching fixation, water rinsing and stabilization. Further, the amount replenished can be also reduced by using means for inhibiting the accumulation of bromide ion in the developing solution. The time of the color developing processing is usually set between 2 and 5 minutes, but the processing time can be also further shortened by setting high temperature and high pH and using the color developing agent at high concentration.

The photograph emulsion layer after color development is usually processed with bleaching. The bleaching processing may be simultaneously carried out at fixation processing (bleaching fixation processing), and may be carried out separately. Further, a treatment method of carrying out the bleaching fixation processing after bleaching processing may be used for accelerating the processing. Furthermore, a method of carrying out the processing in two continuous bleaching processing baths, a method of carrying out the fixation processing before the bleaching fixation processing, or a method of carrying out the bleaching processing after the bleaching fixation processing can be arbitrarily carried out in accordance with purpose. As the bleaching agent, for example, a multi valent metal compound such as Fe (III), peracids, quinines, nitro compounds and the like are used. As the typical bleaching agent, an organic complex salt of Fe (III) such as, for example, aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiamineacetic acid, or complex salts such as citric acid, tartaric acid and malic acid can be used. Among these, Fe (III) complex salts of aminopolycarboxylic acid such as Fe (III) complex salts of ethylenediaminetetraacetic and Fe (III) complex salts of 1,3-diaminopropanetetraacetic acid are preferable from the viewpoints of speedy processing and the prevention of environmental pollution. Further, the Fe (III) complex salts of aminopolycarboxylic acid are useful for the bleaching solution and the bleaching fixation solution in particular. The pH of the bleaching solution or the bleaching fixation solution using these Fe (III) complex salts of aminopolycarboxylic acid is usually 4.0 to 8, but the processing can be also carried out at further low pH for speed-up of the processing.

A bleaching accelerator can be used for the bleaching solution, the bleaching fixation solution and a pre-bath thereof, if necessary. The specific examples of the useful bleaching accelerator are described in the following specifications: compounds having a mercapto group or a disulfide group which are described in U.S. Pat. No. 3,893,858, DE 1,290,812, DE 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and RD No. 17129 (July, 1978); thiazolidine derivatives which are described in JP-A-50-140129; thiourea derivatives which are described in JP-B-45-8506, JP-A-52-20832, JP-A-53-32735 and U.S. Pat. No. 3,706,561; iodide salts which are described in DE 1,127,715 and JP-A-58-16235; polyoxyethylene compounds which are described in DE 966,410 and DE 2,748,430; polyamine compounds which are described in JP-B-45-8836; other compounds which are described in JP-A-49-40943, JP-A-49-59644, JP-A-53-94927, JP-A-54-35727, JP-A-55-26506 and JP-A-58-163940; and bromide ion can be used. Among these, the compounds having a mercapto group or a disulfide group are preferable from the viewpoint that acceleration effect is great, and compounds which are described in U.S. Pat. No. 3,893,858, DE 1,290,812 and JP-A-53-95630 are preferable in particular. Further, a compound described in U.S. Pat. No. 4,552,834 is preferable. These bleaching accelerators may be added to the photosensitive material. When the bleaching fixation of the color photosensitive material for photographing is carried out, these bleaching accelerators are effective in particular. The bleaching solution and the bleaching fixation solution contain preferably an organic acid for preventing bleaching stain in addition to the above-mentioned compounds. Particularly preferable organic acid is a compound having an acid dissociation constant (pKa) of 2 to 5, and specifically, acetic acid, propionic acid, hydroxyacetic acid and the like are preferable. A fixation agent which is used for the fixation solution and the bleaching fixation solution includes a thiosulfric acid salt, a thiocyanic acid salt, a thioether base compound, thioureas, and a large quantity of iodide salts, but the use of a thiosulfric acid salt is general, and ammonium thiosulfate is widely used in particular. Further, a thiosulfric acid salt is preferably used in combination with a thiocyanic acid salt, a thioether base compound and thiourea. As the preserving agent of the fixation solution and the bleaching fixation solution, a sulfurous acid salt, a bisulfurous salt, an addition product of a carbonyl-a bisulfurous salt or sulfinic acid compounds which are described in European Patent No. 294,769A are preferable. Moreover, the addition of aminopolycarboxylic acids and organic phosphonic acids is preferable for the fixation solution and the bleaching fixation solution in order to stabilize the solution. In the present invention, it is preferable for adjusting pH that compounds having a pKa of 6.0 to 9.0 and preferably imidazoles such as imidazole, 1-methylimidazole, 1-ethylimidazole and 2-methylimidazole are added by 0.1 to 10 mol per one liter in the fixation solution or the bleaching fixation solution.

The total time of a step of removing silver is preferably short within a range that badness in removing silver is not generated. The preferable time is 1 minute to 3 minutes, and more preferably 1 minute to 2 minutes. Further, the processing temperature is 25° C. to 50° C., and preferably 35° C. to 45° C. Speed for removing silver is improved at the preferable temperature range, and the generation of stain after processing is effectively prevented. It is preferable to strengthen stirring as powerful as possible in the step of removing silver. The specific method of strengthening the stirring includes a method of letting the jet stream of the processing solution collide on the emulsion surface of a photosensitive material which is described in JP-A-62-183460, a method of enhancing stirring effect using rotational means which is described in JP-A-62-183461, further a method of improving the stirring effect by moving a photosensitive material while bringing an emulsion surface in contact with a wiper blade provided in a solution and disturbing the flow of the emulsion surface, and a method of increasing the circulation amount of the total processing solution. The means for improving stirring is also effective for any one of the bleaching solution, the fixation solution and the bleaching fixation solution. It is considered that the improvement of stirring accelerates the feed of a bleaching agent and a fixation agent and as a result, enhances the speed for removing silver. The means for improving stirring is more effective when a bleaching accelerator is used, and remarkably increases its acceleration effect and can dissolve fixation inhibiting action caused by the bleaching accelerator.

The automatic developing machine used in the present invention has preferably means for conveying a photosensitive material which is described in JP-A-60-191257, JP-A-60-191258 and JP-A-60-191259. As described in the JP-A-60-191257, the conveyance means can remarkably reduce the carrying-in of the processing solution from a pre-bath to a post-bath, an effect for preventing the performance deterioration of the processing solution is high, and it is particularly effective for reducing the processing time in respective steps and the reduction of the amount of the processing solution replenished.

The photosensitive material of the present invention is subject to the steps of rinsing with water and/or stabilizing after the processing of removal of silver in general. The amount of water for rinsing at the step of rinsing with water can be widely set depending on the properties of the photosensitive material (for example, use materials such as a coupler), its use, further, the temperature of water at rinsing, the number (number of steps) of tanks for rinsing with water, the replenishing system such as counter current and follow stream and other various conditions. Among these, the relation between the number of tanks for rinsing with water and a water amount can be determined by a method described in Journal of the Society of Motion Picture and Television Engineers Vol. 64, pages 248 to 253 (May, 1955). According to the multi step counter current described in the literature, the amount of water for rinsing can be greatly reduced, but bacteria breeds because of the increase of residential time of water in a tank, and there occur problems that the floating articles prepared adhere on the photosensitive material, and the like. As a measure for solving the problems, a method of reducing calcium ion and magnesium ion described in JP-A-62-288838 is extremely effective. Further, there can be also used an isothiazolone compound, thiabendazole compounds and chlorine base bactericides such as sodium chlorinated isocyanulate described in JP-A-57-8542, additionally benzotriazoles, and bactericides described in "Chemistry of Antimicrobe and Antifungal agents" (1986) authored by Hiroshi Horiguchi and published by Sankyou Publisher, "Technology of Sterilization of microbe, Disinfection and Fungicide" (1982) edited by Sanitary Technology Society, Industrial Technology Society, "Antimicrobe and Antifungal Dictionary" edited by Japan Antimicrobe and Antifungal Academy (1986). The pH of rinsing water in processing of the photosensitive material of the present invention is 4 to 9 and preferably 5 to 8. The temperature of water at rinsing and the time for rinsing with water can be also set according to the properties of the photosensitive material and its use, but in general, are selected at a range of 15 to 45° C. for 20 seconds to 10 minutes and preferably 25 to 40° C. for 30 seconds to 5 minutes. Further, the photosensitive material of the invention can be also processed directly by a stabilizing solution in place of the above-mentioned rinsing with water. Known methods described in JP-A-57-8543, JP-A-58-14834 and JP-A-60-220345 can be applied in the stabilization processing. Furthermore, the stabilization processing is occasionally further carried out in succession to the rinsing with water. As an example, a stabilizing bath containing a dye stabilizer and a surfactant which is used as the final bath of the color photosensitive material for photographing can be mentioned. The dye stabilizer includes aldehydes such as formalin and glutaraldehyde; N-methylol compounds, hexamethylenetetramine or an adduct of aldehyde with sulfurous acid. Various chelate agents and fungicides can be also added to the stabilizing bath.

The overflow solution in accordance with the replenishment of the above-mentioned water rinsing solution and/or stabilizing solution can be utilized again in other steps such as a step of removing silver using the automatic developer and the like. In the processing using the automatic developer, when the above-mentioned processing solutions are condensed by evaporation, it is preferable to correct concentration by adding water. The photosensitive material of the present invention may store a color developing agent in its inside for simplification and speed-up. In order to internally store it, the precursor of the color developing agent is preferably used. For example, it includes indoaniline compounds described in the specification of U.S. Pat. No. 3,342,597, Schiff's base type compounds described in U.S. Pat. No. 3,342,599 and Research Disclosures No. 14,850 and No. 15,159, aldol compounds described in RD No. 13,924, metal salt complexes described in the specification of U.S. Pat. No. 3,719,492, and urethane compounds described in JP-A-53-135628. The photosensitive material of the present invention may internally store various 1-phenyl-3-pyrazolidones in order to accelerate color development according to requirement. Typical compounds are described in JP-A-56-64339, JP-A-57-144547 and JP-A-58-115438. The processing solution used in processing of the photosensitive material of the present invention is used at 10° C. to 50° C. A temperature of 33° C. to 38° C. is usually standard, but the processing time can be shortened by accelerating the processing at a higher temperature and inversely, the improvement of image quality and the stabilization of the processing solution can be improved by lowering the temperature.

EXAMPLES

The present invention will be described in detail below with reference to the following Examples which however in no way limit the scope of the invention.

EXAMPLES

The present invention will be described in detail below with reference to the following Examples which however in no way limit the scope of the invention.

Example 1

Support

A support used in this example was formed by the following method.

(i) First Layer and Undercoat Layer

Glow discharge was performed on the two surfaces of a 90-μm thick polyethylenenaphthalate support at a processing ambient pressure of 26.6 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

| | |
|---|---|
| Conductive fine-grain dispersion (a water dispersion having an $SnO_2/Sb_2O_5$ grain concentration of 10%, a secondary aggregate having a primary grain size of 0.005 μm and an average grain size of 0.05 μm) | 50 parts by mass |
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly(polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by mass of a Co-deposited γ-$Fe_2O_3$ magnetic substance (average long axis length: 0.25 μm, $S_{BET}$: 39 m$^2$/g, Hc: 6.56×10$^4$ A/m, σs: 77.1 Am$^2$/kg, or: 37.4 Am$^2$/kg), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70 for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (1/4 G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (Average Primary Grain Size 1.5 μm, Specific Surface Area 1.3 $m^2/g$)

Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (1/4 G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 $mL/m^2$ by using a wire bar. The solution was dried at 110° C. The thickness of the dried magnetic layer was 1.0 μm.

(iii) Third Layer (Higher Fatty Acid Ester Slipping Agent-containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| Solution B | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KMB903 (manufactured by Shin-Etsu Silicone) compound 1-1: $(CH_3O)_3Si—(CH_2)_3—NH_2$) | 5.53 parts by mass |
| Compound 1 | 2.93 parts by mass |
| Compound 1 | |

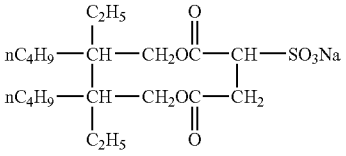

| | |
|---|---|
| SEAHOSTAR KEP50 (amorphous spherical silica, average grain size 0.5 μm, manufactured by NIPPON SHOKUBAI Co., Ltd.) | 88.00 parts by mass |

The above formulation was stirred for 10 min, and the following was further added.

| | |
|---|---|
| Diacetone alcohol | 252.93 parts by mass |

Under ice cooling and stirring, the above solution was dispersed for 3 hr by using the "SONIFIER450 (manufactured by BRANSON K. K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 μm) | 60 parts by mass |
| Methylethylketone | 120 parts by mass |
| Cyclohexanone | 120 parts by mass |
| (solid content 20%, solvent: methylethylketone/cyclohexanone = 1/1) | |

Under ice cooling and stirring, the above solution was dispersed for 2 hr by using the "SONIFIER450 (manufactured by BRANSON K. K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

(iv) Coating of Light-sensitive Layers

The opposite side of the back layers obtained as above was coated with a plurality of layers to make, a multilayer color light-sensitive material, Sample 101.

(Compositions of Light-sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener

ExS: Sensitizing dye

Each coating amount of a silver halide and a colloidal silver is indicated by the amount of silver. Each number of a coupler, an additive and a gelatin indicates the coating amount in units of g/m$^2$. Each number of a sensitizing dye indicates the mole number per mole of silver halides incorporated in the same layer.

(Sample 101)

| | | |
|---|---|---|
| **1st layer (1st antihalation layer)** | | |
| Black colloidal silver | silver | 0.074 |
| Silver iodobromide emulsion (average equivalent-sphere diameter 0.07 μm) | silver | 0.010 |

-continued

| | | |
|---|---|---|
| Gelatin | | 0.740 |
| ExM-1 | | 0.058 |
| ExC-1 | | 0.002 |
| ExC-3 | | 0.002 |
| Cpd-2 | | 0.001 |
| F-8 | | 0.001 |
| HBS-1 | | 0.085 |
| HBS-2 | | 0.011 |
| **2nd layer (2nd antihalation layer)** | | |
| Black colloidal silver | silver | 0.094 |
| Gelatin | | 0.667 |
| ExF-1 | | 0.002 |
| F-8 | | 0.001 |
| Solid disperse dye ExF-7 | | 0.100 |
| HBS-1 | | 0.066 |
| **3rd layer (Interlayer)** | | |
| ExC-2 | | 0.050 |
| Cpd-1 | | 0.089 |
| Polyethylaclyrate latex | | 0.200 |
| HBS-1 | | 0.054 |
| Gelatin | | 0.458 |
| **4th layer (Low-speed red-sensitive emulsion layer)** | | |
| Em-C | silver | 0.300 |
| Em-D | silver | 0.452 |
| ExC-1 | | 0.354 |
| ExC-2 | | 0.014 |
| ExC-3 | | 0.093 |
| ExC-4 | | 0.193 |
| ExC-5 | | 0.034 |
| ExC-6 | | 0.015 |
| ExC-8 | | 0.053 |
| ExC-9 | | 0.020 |
| Cpd-2 | | 0.025 |
| Cpd-4 | | 0.025 |
| Cpd-7 | | 0.015 |
| UV-1 | | 0.022 |
| UV-6 | | 0.042 |
| UV-10 | | 0.009 |
| UV-16 | | 0.075 |
| HBS-1 | | 0.274 |
| HBS-5 | | 0.038 |
| Gelatin | | 2.757 |
| **5th layer (Medium-speed red-sensitive emulsion layer)** | | |
| Em-B | silver | 1.038 |
| ExM-5 | | 0.011 |
| ExC-1 | | 0.304 |
| ExC-2 | | 0.057 |
| ExC-3 | | 0.020 |
| ExC-4 | | 0.135 |
| ExC-5 | | 0.012 |
| ExC-6 | | 0.039 |
| ExC-8 | | 0.016 |
| ExC-9 | | 0.077 |
| Cpd-2 | | 0.056 |
| Cpd-4 | | 0.035 |
| Cpd-7 | | 0.020 |
| HBS-1 | | 0.190 |
| Gelatin | | 1.423 |
| **6th layer (High-speed red-sensitive emulsion layer)** | | |
| Em-A | silver | 1.027 |
| ExM-5 | | 0.156 |
| ExC-1 | | 0.066 |
| ExC-3 | | 0.015 |
| ExC-6 | | 0.027 |
| ExC-8 | | 0.114 |
| ExC-9 | | 0.089 |
| ExC-10 | | 0.107 |
| ExY-3 | | 0.010 |
| Cpd-2 | | 0.070 |
| Cpd-4 | | 0.079 |
| Cpd-7 | | 0.030 |
| HBS-1 | | 0.314 |
| HBS-2 | | 0.120 |
| Gelatin | | 1.206 |

-continued

| | | |
|---|---|---|
| **7th layer (Interlayer)** | | |
| Cpd-1 | | 0.078 |
| Cpd-6 | | 0.369 |
| Solid disperse dye ExF-4 | | 0.030 |
| HBS-1 | | 0.048 |
| Polyethylacrylate latex | | 0.088 |
| Gelatin | | 0.739 |
| **8th layer (layer for donating interlayer effect to red-sensitive layer)** | | |
| Em-E | silver | 0.358 |
| Cpd-4 | | 0.034 |
| ExM-2 | | 0.121 |
| ExM-3 | | 0.002 |
| ExM-4 | | 0.035 |
| ExY-1 | | 0.018 |
| ExY-4 | | 0.038 |
| ExC-7 | | 0.036 |
| HBS-1 | | 0.343 |
| HBS-3 | | 0.006 |
| HBS-5 | | 0.030 |
| Gelatin | | 0.884 |
| **9th layer (Low-speed green-sensitive emulsion layer)** | | |
| Em-H | silver | 0.255 |
| Em-I | silver | 0.268 |
| Em-J | silver | 0.334 |
| ExM-2 | | 0.344 |
| ExM-3 | | 0.055 |
| ExY-1 | | 0.018 |
| ExY-3 | | 0.014 |
| ExC-7 | | 0.004 |
| HBS-1 | | 0.505 |
| HBS-3 | | 0.012 |
| HBS-4 | | 0.095 |
| HBS-5 | | 0.055 |
| Cpd-5 | | 0.010 |
| Cpd-7 | | 0.020 |
| Gelatin | | 1.382 |
| **10th layer (Medium-speed green-sensitive emulsion layer)** | | |
| Em-G | Silver | 0.394 |
| ExM-2 | | 0.046 |
| ExM-3 | | 0.033 |
| ExM-5 | | 0.019 |
| ExY-3 | | 0.006 |
| ExC-6 | | 0.010 |
| ExC-7 | | 0.011 |
| ExC-8 | | 0.010 |
| ExC-9 | | 0.009 |
| HBS-1 | | 0.046 |
| HBS-3 | | 0.002 |
| HBS-4 | | 0.035 |
| HBS-5 | | 0.020 |
| Cpd-5 | | 0.004 |
| Cpd-7 | | 0.010 |
| Gelatin | | 0.446 |
| **11th layer (High-speed green-sensitive emulsion layer)** | | |
| Em-F | silver | 0.479 |
| Em-H | silver | 0.306 |
| ExC-6 | | 0.007 |
| ExC-8 | | 0.012 |
| ExC-9 | | 0.014 |
| ExM-1 | | 0.019 |
| ExM-2 | | 0.056 |
| ExM-3 | | 0.013 |
| ExM-4 | | 0.034 |
| ExM-5 | | 0.039 |
| ExM-6 | | 0.021 |
| ExY-3 | | 0.005 |
| Cpd-3 | | 0.005 |
| Cpd-4 | | 0.007 |
| Cpd-5 | | 0.010 |
| Cpd-7 | | 0.020 |
| HBS-1 | | 0.248 |
| HBS-3 | | 0.003 |

-continued

| | | |
|---|---|---|
| HBS-4 | | 0.094 |
| HBS-5 | | 0.037 |
| Polyethylacrylate latex | | 0.099 |
| Gelatin | | 0.950 |
| **12th layer (Yellow filter layer)** | | |
| Cpd-1 | | 0.090 |
| Solid disperse dye ExF-2 | | 0.070 |
| Solid disperse dye ExF-5 | | 0.010 |
| Oil-soluble dye ExF-6 | | 0.010 |
| HBS-1 | | 0.055 |
| Gelatin | | 0.589 |
| **13th layer (Low-speed blue-sensitive emulsion layer)** | | |
| Em-M | silver | 0.327 |
| Em-N | silver | 0.174 |
| Em-O | silver | 0.097 |
| ExC-1 | | 0.006 |
| ExC-3 | | 0.033 |
| ExC-7 | | 0.014 |
| ExY-1 | | 0.088 |
| ExY-2 | | 0.404 |
| ExY-4 | | 0.056 |
| ExY-5 | | 0.404 |
| Cpd-2 | | 0.102 |
| Cpd-3 | | 0.004 |
| HBS-1 | | 0.337 |
| HBS-5 | | 0.070 |
| Gelatin | | 1.876 |
| **14th layer (High-speed blue-sensitive emulsion layer)** | | |
| Em-L | silver | 0.458 |
| Em-K | silver | 0.397 |
| ExM-5 | | 0.012 |
| ExC-1 | | 0.010 |
| ExY-1 | | 0.041 |
| ExY-2 | | 0.119 |
| ExY-3 | | 0.008 |
| ExY-4 | | 0.070 |
| ExY-5 | | 0.120 |
| Cpd-2 | | 0.074 |
| Cpd-3 | | 0.001 |
| Cpd-7 | | 0.030 |
| HBS-1 | | 0.122 |
| Gelatin | | 0.905 |
| **15th layer (1st protective layer)** | | |
| Silver iodobromide emulsion (average equivalent-sphere diameter 0.07 μm) | silver | 0.306 |
| UV-32 | | 0.155 |
| UV-1 | | 0.074 |
| UV-6 | | 0.078 |
| UV-10 | | 0.010 |
| UV-16 | | 0.175 |
| F-11 | | 0.008 |
| S-1 | | 0.077 |
| HBS-1 | | 0.175 |
| HBS-4 | | 0.017 |
| Gelatin | | 1.257 |
| **16th layer (2nd protective layer)** | | |
| H-1 | | 0.400 |
| B-1 (diameter 1.7 μm) | | 0.050 |
| B-2 (diameter 1.7 μm) | | 0.150 |
| B-3 | | 0.029 |
| S-1 | | 0.200 |
| Gelatin | | 0.748 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid disperse dye ExF-2. The average grain size of the fine dye grains was 0.29 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

Emulsions used in the present invention and chemical structural formulae or chemical names of compounds will be shown below.

TABLE 1

| Emulsion name | Layer used | Grain structure Iodide structure = Content ratio of silver amount (AgI content ratio/%) |
|---|---|---|
| Em-A | High-speed red-sensitive layer | Triple struc. = 12/59/29(0/11/8) Tabular grain |
| Em-B | Medium-speed red-sensitive layer | Triple struc. = 40/10/50(1/38/1) Cubic grain |
| Em-C | Low-speed red-sensitive layer | Uniform struc. Cubic grain |
| Em-D | Low-speed red-sensitive layer | Uniform struc. Cubic grain |
| Em-E | Layer for donating interlayer effect to red-sensitive layer | Triple struc. = 12/59/29(0/11/8) Tabular grain |
| Em-F | High-speed green-sensitive layer | Triple struc. = 12/59/29(0/11/8) Tabular grain |
| Em-G | Medium-speed green-sensitive layer | Triple struc. = 40/10/50(1/38/1) Octahedral grain |
| Em-H | High and low-speed green-sensitive layers | Triple struc. = 45/5/50(1/38/1) Octahedral grain |
| Em-I | Low-speed green-sensitive layer | Triple struc. = 45/5/50(1/38/1) Octahedral grain |
| Em-j | Low-speed green-sensitive layer | Triple struc. = 45/5/50(1/38/1) Octahedral grain |
| Em-K | High-speed blue-sensitive layer | Triple struc. = 8/59/33(0/11/8) Tabular grain |
| Em-L | High-speed blue-sensitive layer | Triple struc. = 8/59/33(0/11/8) Tabular grain |
| Em-M | Low-speed blue-sensitive layer | Uniform struc. Tabular grain |
| Em-N | Low-speed blue-sensitive layer | Uniform struc. Tabular grain |
| Em-O | Low-speed blue-sensitive layer | Uniform struc. Tabular grain |

| Emulsion name | Av. AgI content (%) | Av. equivalent-sphere diameter (μm) | Variation coefficient of av. equivalent-sphere diameter (%) | Av. aspect ratio | Av. equivalent-circuler diameter (μm) |
|---|---|---|---|---|---|
| Em-A | 8.8 | 0.65 | 22 | 6.5 | 1.06 |
| Em-B | 4.7 | 0.40 | 10 | 1 | — |
| Em-C | 2.0 | 0.30 | 14 | 1 | — |
| Em-D | 2.0 | 0.20 | 12 | 1 | — |
| Em-E | 8.8 | 0.60 | 25 | 7.2 | 1.01 |
| Em-F | 8.8 | 0.60 | 25 | 7.2 | 1.01 |
| Em-G | 4.7 | 0.45 | 10 | 1 | — |
| Em-H | 3.0 | 0.28 | 19 | 1 | — |
| Em-I | 2.9 | 0.25 | 18 | 1 | — |
| Em-J | 2.9 | 0.15 | 16 | 1 | — |
| Em-K | 9.0 | 0.89 | 24 | 2.9 | 1.13 |
| Em-L | 9.0 | 0.78 | 23 | 2.5 | 0.93 |
| Em-M | 4.0 | 0.60 | 25 | 6.5 | 0.95 |
| Em-N | 3.0 | 0.40 | 28 | 4.5 | 0.56 |
| Em-O | 3.0 | 0.20 | 30 | 2.5 | 0.24 |

The compounds used in the individual layers will be shown below.
ExF-1
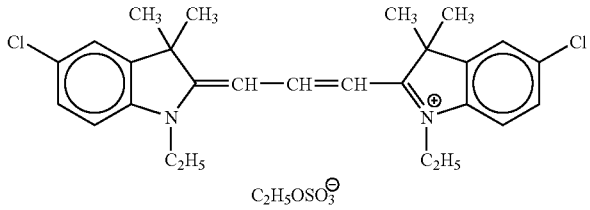
ExF-2
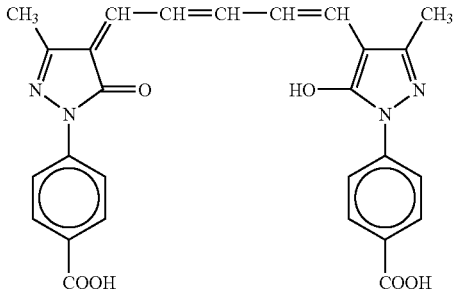
ExF-4
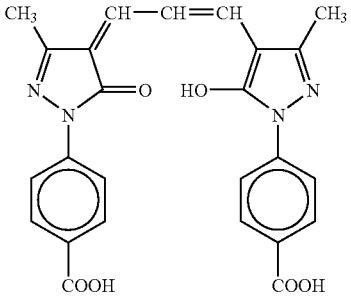
ExF-5
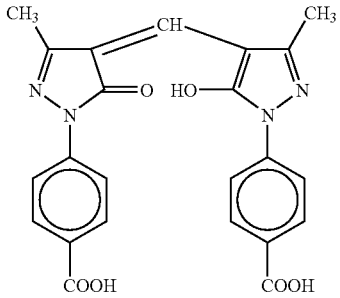
ExF-6
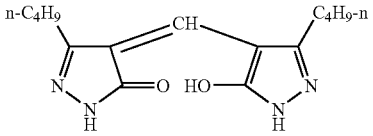
ExF-7
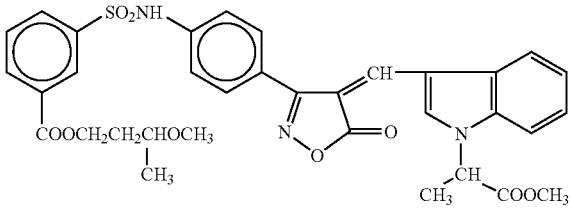
ExC-1
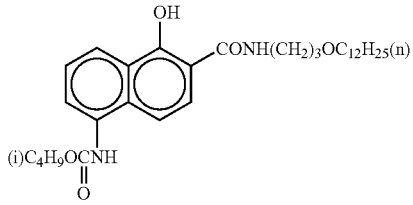
ExC-2
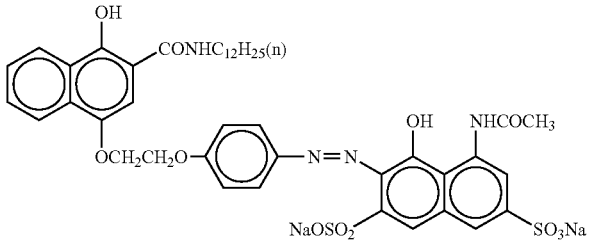
ExC-3
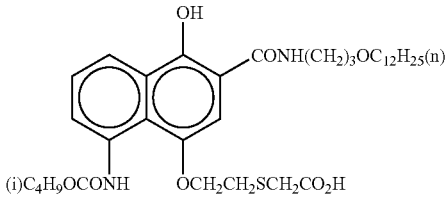
ExC-4
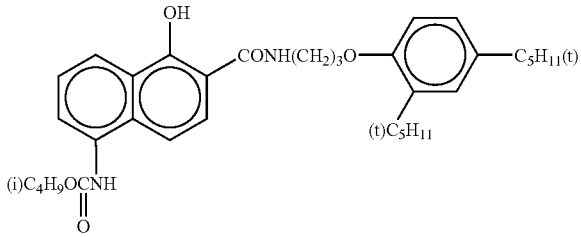

-continued
ExC-5
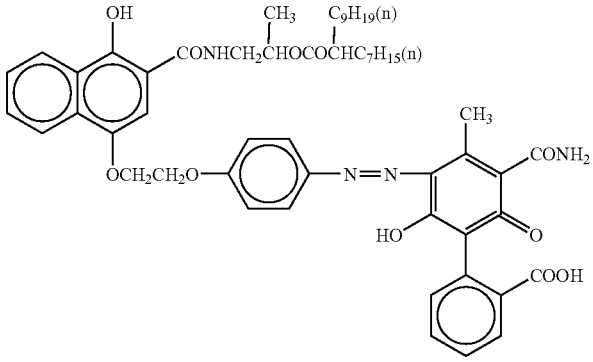
ExC-6
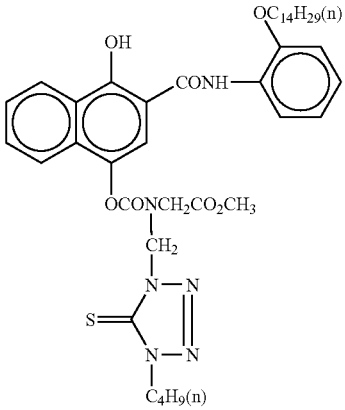
ExC-7
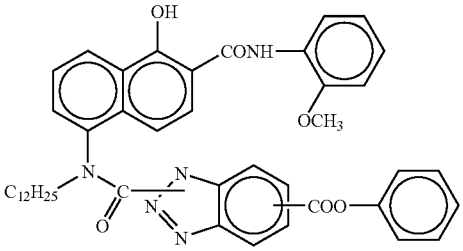
ExC-8
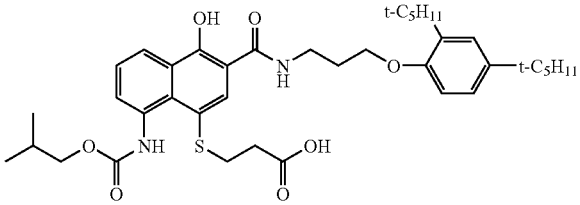
ExC-9
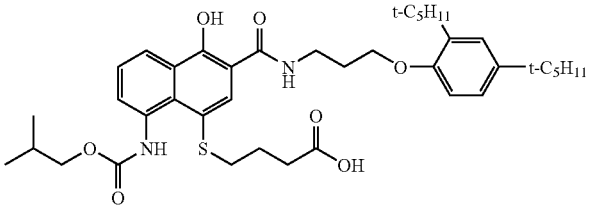
ExC-10
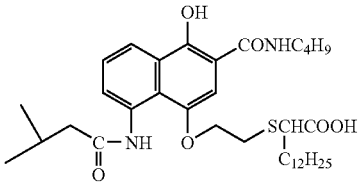
ExM-1
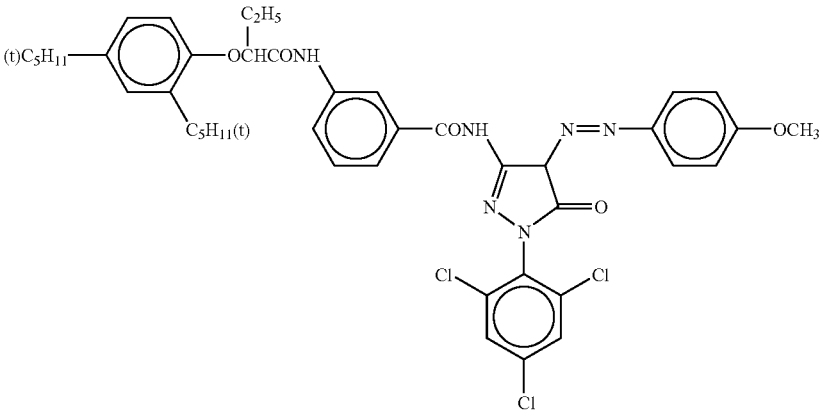

-continued
ExM-2
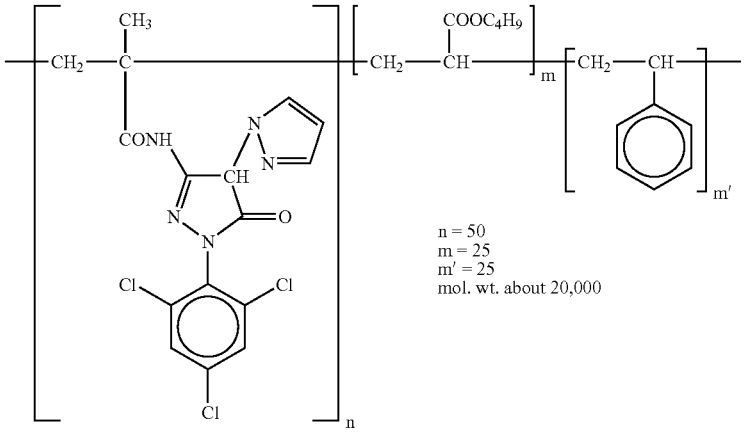
ExM-3
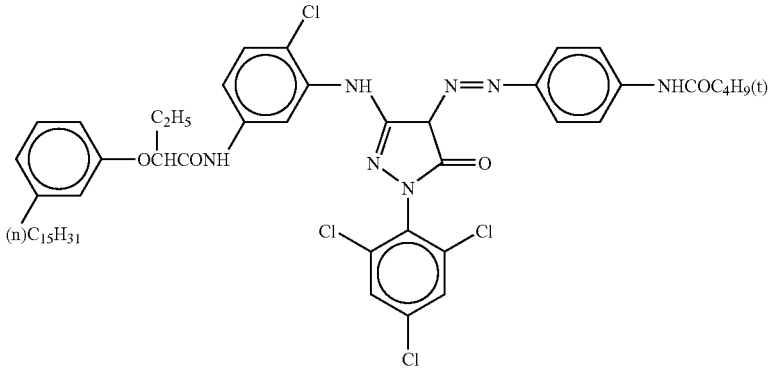
ExM-4
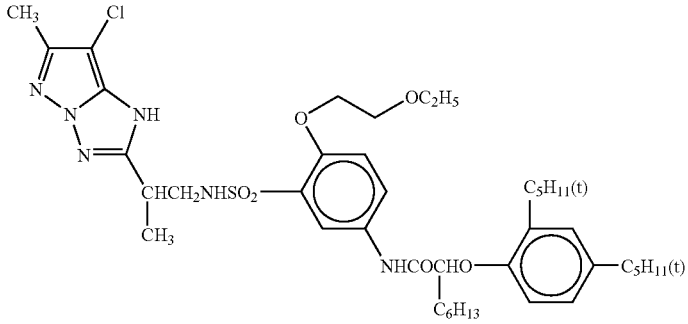
ExM-5
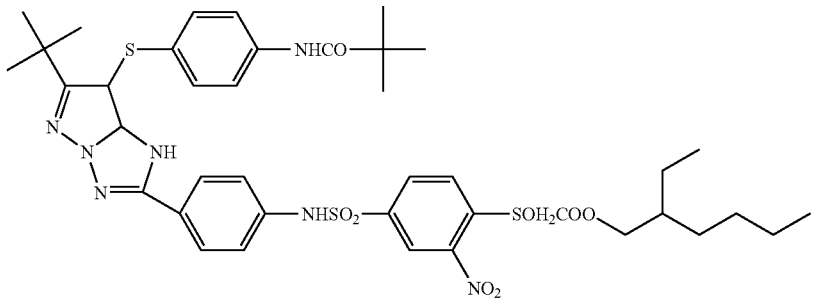

-continued
ExM-6
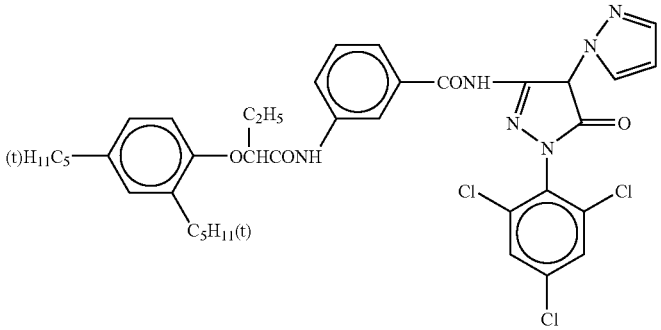
ExY-1
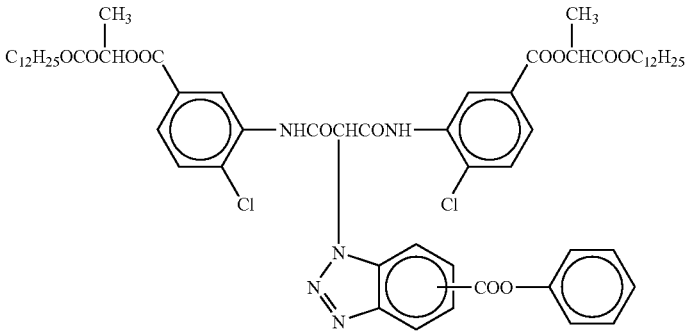
ExY-2
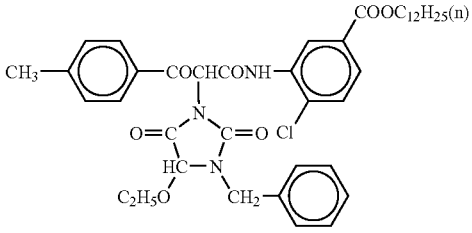
ExY-3
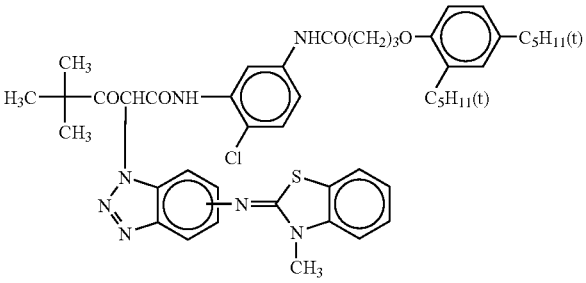
ExY-4
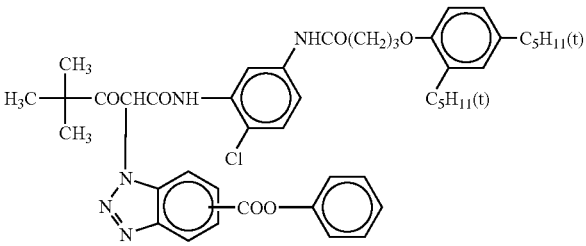
ExY-5
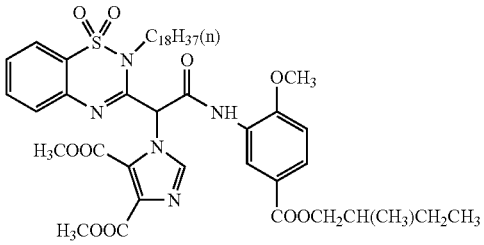
Cpd-1
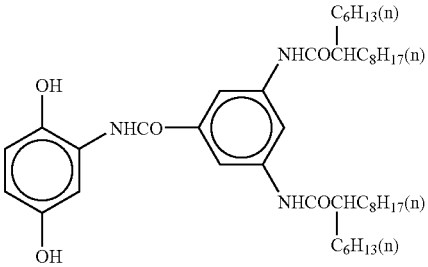
Cpd-2
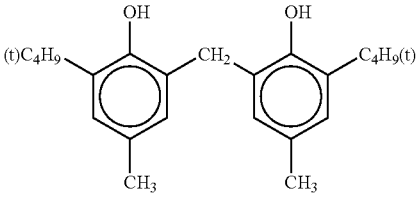

-continued

Cpd-3

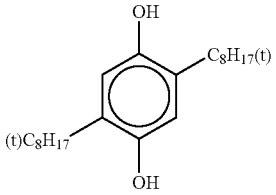

Cpd-4

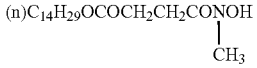

Cpd-5

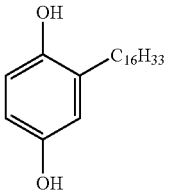

Cpd-6

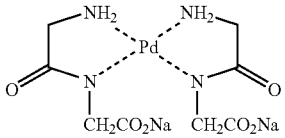

Cpd-7

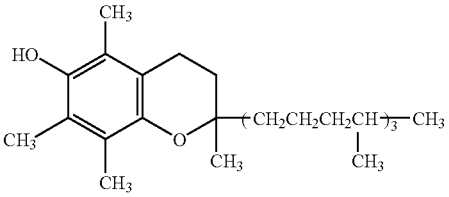

B-1

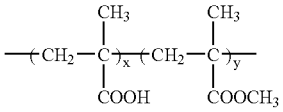

x/y = 10/90 (mass ratio)
Weight-average molecular weight: about 35,000

B-2

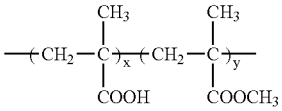

x/y = 40/60 (mass ratio)
Weight-average molecular weight: about 20,000

B-3

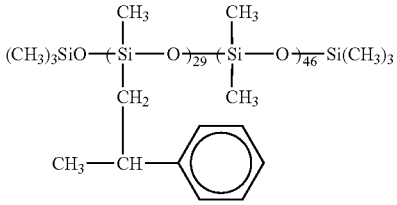

(mole ratio)
Weight-average molecular weight: about 8,000

B-4

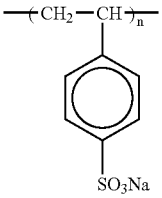

Weight-average molecular weight: about 750,000

B-5

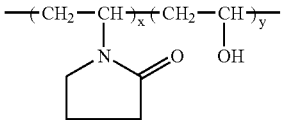

x/y = 70/30 (mass ratio)
Weight-average molecular weight: about 17,000

B-6

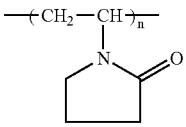

Weight-average molecular weight: about 10,000

HBS-1

Tricresyl phosphate

HBS-2

Di-n-butyl phthalate

HBS-3

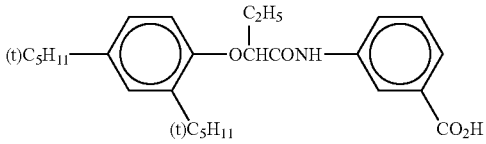

Tri (2-ethylhexyl) phosphate
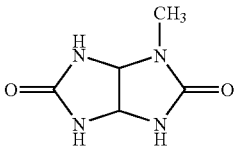
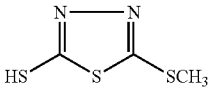
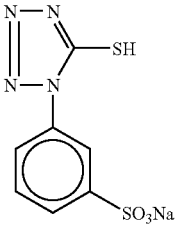
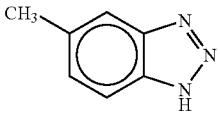
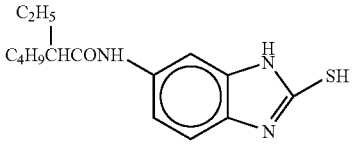
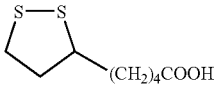
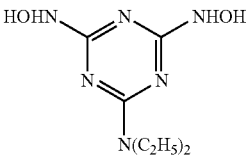
-continued
HBS-4
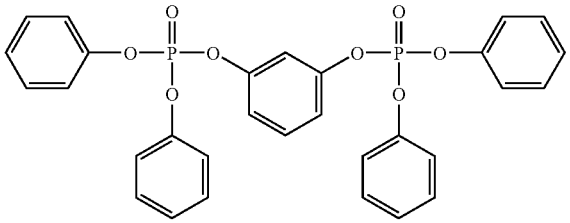
HBS-5
S-1
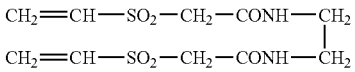
H-1
F-1
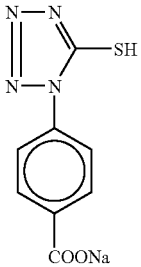
F-2
F-3
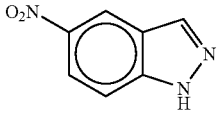
F-4
F-5
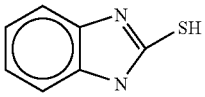
F-6
F-7
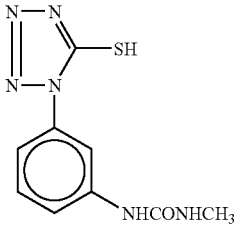
F-8
F-9
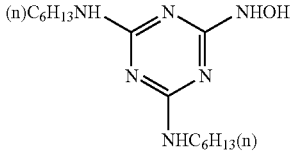
F-10
F-11
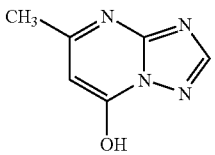
F-12

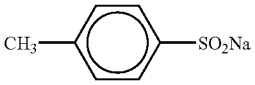

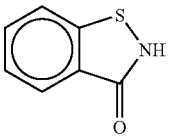

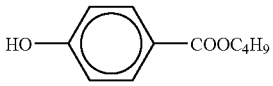

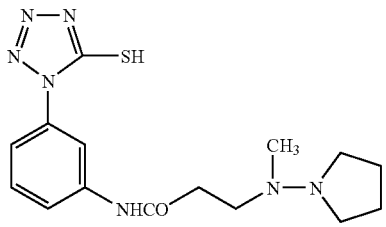

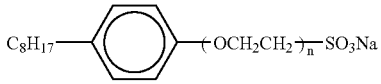

n = 2 to 4

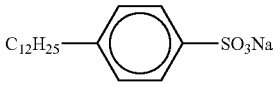

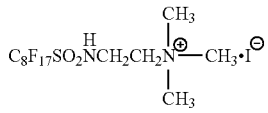

-continued

F-13

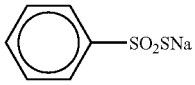

F-14

F-15

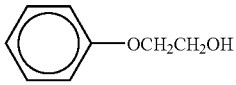

F-16

F-17

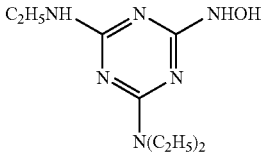

F-18

F-19

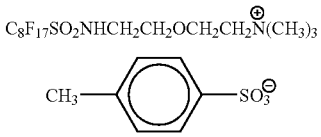

W-1

W-2

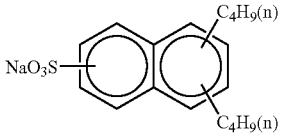

W-3

W-4

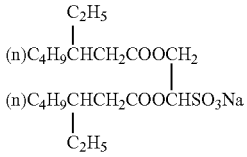

W-5

W-6

(Preparation of Samples 102 to 107)

Samples were prepared in the same manner as in the sample 101 except that the dye was added as shown in Table 2 in the sample 101 and the non high molecular weight ultraviolet absorbent of the 15$^{th}$ layer was replaced as shown in Table 2.

TABLE 2

| | Magenta dye D-8 | | | Green-sensitive layer | | Drying | |
|---|---|---|---|---|---|---|---|
| Sample No. | Layer added | Addition amount (mg/m$^2$) | Ultraviolet absorbent (15th layer) | Sensitivity | Sharpness Relative MTF (25 c/mm) | test for scratch resistance | Remark |
| 101 | — | — | UV-1, 6, 10, 16, 32 | Control | 100 | 63 g | Comp. |
| 102 | 14$^{th}$ layer | 5.8 | UV-1, 6, 10, 16, 32 | −0.03 | 107 | 48 g | Comp. |
| 103 | — | — | A | −0.02 | 90 | 100 g≦ | Comp. |
| 104 | — | — | B | −0.03 | 86 | 100 g≦ | Comp. |
| 105 | 14$^{th}$ layer | 5.8 | A | −0.03 | 108 | 100 g≦ | Inv. |
| 106 | 15$^{th}$ layer | 5.2 | A | −0.02 | 116 | 100 g≦ | Inv. |
| 107 | 15$^{th}$ layer | 5.2 | B | −0.03 | 112 | 100 g≦ | Inv. |

The method of adding the magenta dye D-8 is as shown below. 17.5 g of the magenta dye D-8 and 15 cc of a high boiling organic solvent (HBS-1) were added to 100 cc of ethyl acetate, and the mixture was heated to 40° C. to be completely dissolved. The ethyl acetate solution was mixed with 400 g of a 13% gelatin aqueous solution which contains 7.0 g of a surfactant (W-4), and the mixed solution was dispersed to emulsion with a homo-blender. The emulsified dispersion thus obtained was added to the objective layer.

A polymer impregnated with the non high molecular weight ultraviolet absorbent in place of the non high molecular weight ultraviolet absorbent contained in the 15$^{th}$ layer was prepared as follow.

Preparation of Polymer A Impregnated with Non High Molecular Weight Ultraviolet Absorbent Referring to the specification of U.S. Pat. No. 5,385,815, a polymer impregnated with the non high molecular weight ultraviolet absorbent was prepared by using POL-1 and POL-2 as the ultraviolet absorbents and UV-31 and UV-34 as the non high molecular weight ultraviolet absorbents, and the polymer impregnated with the non high molecular weight ultraviolet absorbent were combined so that UV absorption was similar as the sample 101.

POL-1

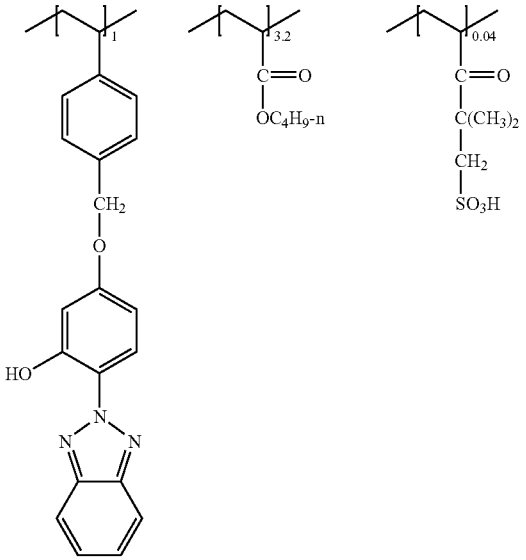

POL-2

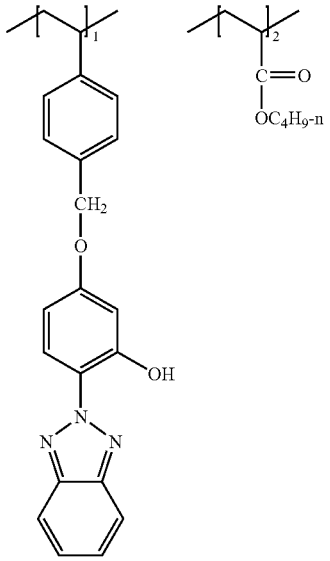

Preparation of Polymer B Impregnated with Non High Molecular Weight Ultraviolet Absorbent Polymer was similarly prepared except that UV-31 and UV-34 among the polymer A impregnated with the non high molecular weight ultraviolet absorbent were changed to UV-1 and UV-16.

The wedge exposure of the sample prepared as above was carried out with white light and then, development processing was carried out by the processing step shown in the under-description.

The processing method is shown below. The samples 101 to 107 exposed above were processed by the method described below (until the cumulative replenishing amount of the color developing replenishing solution became 3-fold of the tank volume of its mother solution) using a NegaProcessor: FP-350 manufactured by Fuji Photo Film Co., Ltd.

The compositions of the processing solutions are presented below.

| (Color developer) | [Tank solution] (g) | [Replenisher] (g) |
|---|---|---|
| Diethylenetriamine pentaacetic acid | 1.0 | 1.1 |
| 1-hydroxyethylidene-1,1-diphosphonate | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methyl aniline sulfate | 4.5 | 5.5 |
| Water to make | 1.0 L | 1.0 L |
| pH (adjusted by potassium hydroxide and surfuric acid) | 10.05 | 10.10 |

| (Bleaching solution) common to tank solution and replenisher | (g) |
|---|---|
| Ethylenediaminetetraacetic acid Fe(III) ammonium.dihydrate | 120.0 |
| Ethylenediaminetetraacetic acid.disodium salt | 10.0 |
| Ammonium bromide | 100.0 |
| Ammonium nitrate | 10.0 |
| Bleaching accelerator $[(CH_3)_2N—CH_2CH_2—S—S—CH_2CH_2—N(CH_3)_2.2HCl]$ | 0.005 mol |
| Ammonia water (27%) | 15.0 mL |
| Water to make | 1.0 L |
| pH (adjusted by ammonia water and nitric acid) | 6.3 |

| (Bleach-fixing solution) | [Tank solution] (g) | [Replenisher] (g) |
|---|---|---|
| Ethylenediaminetetraacetic acid.Fe(III).ammonium. dihydrate | 50.0 | — |
| Ethylenediaminetetraacetic acid.disodium salt. | 5.0 | 2.0 |
| Sodium sulfite | 12.0 | 20.0 |
| Ammonium thiosulfate aqueous solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

The concentrations of the samples 101 to 107 after the above-mentioned development processing were measured, and the photographic sensitivities were evaluated by the logarithm of the reciprocal number of exposure providing the concentration of a magenta concentration plus 0.5. Sharpnesses were determined by exposing the MTF pattern and carrying out the similar processing as the above-description. Further, scratch resistance was evaluated referring to U.S. Pat. No. 5,385,815, the entire contents of which are incorporated herein by reference. The results obtained as above are collectively described in Table 2.

As cleared from Table 2, it is grasped that when a fixed magenta dye was charged in a photographic composing layer which was farther than the green-sensitive emulsion layer from a support, sharpness is remarkably improved by combination with the polymer impregnated with the ultraviolet absorbent.

Example 2

(Preparation of Sample 201)

The sample 201 was prepared in the same manner as in the sample of Example 1 except that emulsions were replaced as shown in Table 3 to Table 7.

TABLE 3

| Emulsion name | Layer used | Grain shape | Av. equivalent-sphere diameter (μm) |
|---|---|---|---|
| Em-A | High-speed red-sensitive layer | (111) main plane grain | 0.62 |
| Em-B | Medium-speed red-sensitive layer | (111) main plane grain | 0.49 |
| Em-C | Low-speed red-sensitive layer | (111) main plane grain | 0.35 |
| Em-D | Low-speed red-sensitive layer | (111) main plane grain | 0.30 |
| Em-E | Layer for donating interlayer effect to red-sensitive layer | (111) main plane grain | 0.81 |
| Em-F | High-speed green-sensitive layer | (111) main plane grain | 0.65 |
| Em-G | Medium-speed green-sensitive layer | (111) main plane grain | 0.48 |
| Em-H | High and low-speed green-sensitive layers | (111) main plane grain | 0.38 |
| Em-I | Low-speed green-sensitive layer | (111) main plane grain | 0.37 |
| Em-J | Low-speed green-sensitive layer | (111) main plane grain | 0.29 |
| Em-K | High-speed blue-sensitive layer | (111) main plane grain | 0.83 |
| Em-K' | High-speed blue-sensitive layer | (111) main plane grain | 0.83 |
| Em-L | Low-speed blue-sensitive layer | (111) main plane grain | 0.62 |
| Em-M | Low-speed blue-sensitive layer | (111) main plane grain | 0.53 |
| Em-N | Low-speed blue-sensitive layer | (111) main plane grain | 0.37 |
| Em-O | Low-speed blue-sensitive layer | (110) main plane grain | 0.21 |

| Emulsion name | Av. equivalent-circular diameter (μm)/variation coefficient (%) | Av. grain thickness (μm)/variation coefficient (%) | Av. aspect ratio | Ratio of *tabular grains to total projected area occupied by all the grains (%) |
|---|---|---|---|---|
| Em-A | 1.03/27 | 0.14/13 | 8 | 91 |
| Em-B | 0.76/25 | 0.13/15 | 6 | 83 |
| Em-C | 0.51/19 | 0.12/12 | 4 | 72 |
| Em-D | 0.38/18 | 0.14/9.5 | 3 | 59 |
| Em-E | 1.65/27 | 0.15/13 | 12 | 93 |
| Em-F | 1.09/24 | 0.14/15 | 8 | 92 |
| Em-G | 0.75/25 | 0.13/15 | 7 | 85 |
| Em-H | 0.53/16 | 0.13/11 | 4 | 69 |
| Em-I | 0.45/19 | 0.19/13 | 2.3 | 41 |
| Em-J | 0.35/22 | 0.14/18 | 2.8 | 51 |
| Em-K | 1.12/25 | 0.29/21 | 4 | 74 |
| Em-K' | 1.00/25 | 0.39/18 | 2.5 | 44 |
| Em-L | 0.86/22 | 0.21/23 | 4 | 74 |
| Em-M | 0.82/26 | 0.19/19 | 4 | 70 |
| Em-N | 0.55/18 | 0.13/16 | 4 | 71 |
| Em-O | 0.21/20 | 0.21/20 | 1 | — |

*Tabular grains having an aspect ratio of 3 or more

TABLE 4

| Emulsion name | Layer used | Av. silver iodide content (mol %)/intergrain variation coefficient (%) | Av. silver chloride content (mol %)/intergrain variation coefficient (%) |
|---|---|---|---|
| Em-A | High-speed red-sensitive layer | 5.3/10.0 | 0/0 |
| Em-B | Medium-speed red-sensitive layer | 4.7/11.0 | 0/0 |
| Em-C | Low-speed red-sensitive layer | 3.6/10.0 | 0/0 |
| Em-D | Low-speed red-sensitive layer | 3.5/11.0 | 0/0 |
| Em-E | Layer for donating interlayer effect to red-sensitive layer | 5.2/10.0 | 0/0 |
| Em-F | High-speed green-sensitive layer | 5.5/10.0 | 0/0 |
| Em-G | Medium-speed green-sensitive layer | 4.7/13.0 | 0/0 |
| Em-H | High and low-speed green-sensitive layers | 5.0/14.0 | 0/0 |
| Em-I | Low-speed green-sensitive layer | 3.7/12.0 | 0/0 |
| Em-J | Low-speed green-sensitive layer | 3.6/14.0 | 0/0 |
| Em-K | High-speed blue-sensitive layer | 6.5/7.0 | 0/0 |
| Em-L | Low-speed blue-sensitive layer | 6.3/8.0 | 0/0 |
| Em-M | Low-speed blue-sensitive layer | 6.8/9.0 | 0/0 |
| Em-N | Low-speed blue-sensitive layer | 3.7/10.0 | 0/0 |
| Em-O | Low-speed blue-sensitive layer | 1.9/9.0 | 0/0 |

| Emulsion name | Twin plane spacing (μm)/variation coefficient (%) | Av. thickness of core portion (μm) | Number of dislocation lines | (100) face ratio in side planes (%) |
|---|---|---|---|---|
| Em-A | 0.011/30 | 0.10 | 10≦ | 20 |
| Em-B | 0.010/30 | 0.08 | 10≦ | 30 |
| Em-C | 0.010/31 | 0.08 | 10≦ | 25 |
| Em-D | 0.009/29 | 0.11 | 10≦ | 25 |
| Em-E | 0.012/30 | 0.10 | 10≦ | 35 |
| Em-F | 0.012/30 | 0.11 | 10≦ | 20 |
| Em-G | 0.010/30 | 0.10 | 10≦ | 30 |
| Em-H | 0.011/30 | 0.10 | 10≦ | 30 |
| Em-I | 0.016/32 | 0.13 | 10≦ | 20 |
| Em-J | 0.016/32 | 0.10 | 10≦ | 35 |
| Em-K | 0.010/29 | 0.22 | 10≦ | 40 |
| Em-L | 0.017/33 | 0.19 | 10≦ | 20 |
| Em-M | 0.019/30 | 0.10 | 10≦ | 30 |
| Em-N | 0.020/31 | 0.09 | 10≦ | 30 |
| Em-O | —/— | — | — | — |

TABLE 5

| Emulsion name | Layer used | Characteristics of grains occupying 50% or more in number of all the grains |
|---|---|---|
| Em-A | High-speed red-sensitive layer | (111) main plane tabular grain |
| Em-B | Medium-speed red-sensitive layer | (111) main plane tabular grain |
| Em-C | Low-speed red-sensitive layer | (111) main plane tabular grain |
| Em-D | Low-speed red-sensitive layer | (111) main plane tabular grain |
| Em-E | Layer for donating interlayer effect to red-sensitive layer | (111) main plane tabular grain |
| Em-F | High-speed green-sensitive layer | (111) main plane tabular grain |
| Em-G | Medium-speed green-sensitive layer | (111) main plane tabular grain |
| Em-H | High and low-speed green-sensitive layers | (111) main plane tabular grain |
| Em-I | Low-speed green-sensitive layer | (111) main plane tabular grain |
| Em-J | Low-speed green-sensitive layer | (111) main plane tabular grain |
| Em-K | High-speed blue-sensitive layer | (111) main plane tabular grain |
| Em-L | High-speed blue-sensitive layer | (111) main plane tabular grain |
| Em-M | Low-speed blue-sensitive layer | (111) main plane tabular grain |
| Em-N | Low-speed blue-sensitive layer | (111) main plane tabular grain |
| Em-O | Low-speed blue-sensitive layer | (100) main plane cubic grain |

| Emulsion name | Silver amount ratio of grain structure (%) and halogen composition (listed in order from center of grain) |
|---|---|
| Em-A | (11%)AgBr/(35%)$AgBr_{97}I_3$/(18%)AgBr/(9%)$AgBr_{62}I_{38}$/(27%)AgBr |
| Em-B | (7%)AgBr/(31%)$AgBr_{97}I_3$/(16%)AgBr/(12%)$AgBr_{62}I_{38}$/(34%)AgBr |
| Em-C | (1%)AgBr/(77%)$AgBr_{99}I_1$/(9%)$AgBr_{95}I_5$/(13%)AgBr |
| Em-D | (57%)AgBr/(14%)$AgBr_{96}I_4$/(29%)AgBr |

TABLE 5-continued

| | |
|---|---|
| Em-E | (13%)AgBr/(36%)$AgBr_{97}I_3$/(7%)AgBr/(11%)$AgBr_{62}I_{38}$/(33%)AgBr |
| Em-F | (11%)AgBr/(35%)$AgBr_{97}I_3$/(18%)AgBr/(4%)AgI/(32%)AgBr |
| Em-G | (7%)AgBr/(31%)$AgBr_{97}I_3$/(15%)AgBr/(14%)$AgBr_{62}I_{38}$(33%)AgBr |
| Em-H | (14%)AgBr/(36%)$AgBr_{97}I_3$/(7%)AgBr/(11%)$AgBr_{62}I_{38}$/(32%)AgBr |
| Em-I | (15%)AgBr/(44%)$AgBr_{97}I_3$/(11%)AgBr/(5%)AgI/(25%)AgBr |
| Em-J | (60%)AgBr/(2%)AgI/(38%)AgBr |
| Em-K | (68%)$AgBr_{93}I_7$/(21%)AgBr/(1%)AgI/(10%)AgBr |
| Em-L | (8%)AgBr/(10%)$AgBr_{95}I_5$/(52%)$AgBr_{93}I_7$/(11%)AgBr/(2%)AgI/(17%)AgBr |
| Em-M | (12%)AgBr/(43%)$AgBr_{90}I_{10}$/(14%)AgBr/(2%)AgI/(29%)AgBr |
| Em-N | (58%)AgBr/(4%)AgI/(38%)AgBr |
| Em-O | (6%)AgBr/(94%)$AgBr_{96}I_4$ |

TABLE 6

| Emulsion name | Layer used | Sensitizing dye | Dopant |
|---|---|---|---|
| Em-A | High-speed red-sensitive layer | 1, 3, 4 | $K_2IrCl_6$ |
| Em-B | Medium-speed red-sensitive layer | 2, 3, 4 | $K_2IrCl_6$, $K_2IrCl_5(H_2O)$, $K_4Ru(CN)_6$ |
| Em-C | Low-speed red-sensitive layer | 1, 3, 4 | $K_2IrCl_6$, $K_4Fe(CN)_6$ |
| Em-D | Low-speed red-sensitive layer | 1, 3, 4 | $K_2IrCl_6$, $K_4Fe(CN)_6$ |
| Em-E | Layer for donating interlayer effect to red-sensitive layer | 5, 10 | $K_4Fe(CN)_6$ |
| Em-F | High-speed green-sensitive layer | 5, 6, 9 | — |
| Em-G | Medium-speed green-sensitive layer | 5, 6, 9 | $K_2IrCl_6$, $K_4Fe(CN)_6$ |
| Em-H | High and low-speed green-sensitive layers | 5, 6, 7, 8, 9 | $K_2IrCl_6$, $K_4Fe(CN)_6$ |
| Em-I | Low-speed green-sensitive layer | 6, 8, 9 | $K_2IrCl_6$ |
| Em-J | Low-speed green-sensitive layer | 5, 6, 7 | $K_2IrCl_6$, $K_4Fe(CN)_6$ |
| Em-K | High-speed blue-sensitive layer | 14 | — |
| Em-L | High-speed blue-sensitive layer | 12 | — |
| Em-M | Low-speed blue-sensitive layer | 14 | — |
| Em-N | Low-speed blue-sensitive layer | 12, 13 | — |
| Em-O | Low-speed blue-sensitive layer | 11, 13 | $K_2IrCl_6$ |

The sensitizing dyes described in Tables 5 and 6 will be shown below.

Sensitizing dye 1

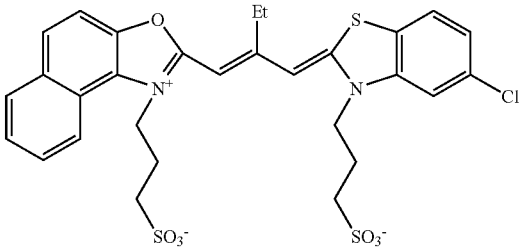

Sensitizing dye 2

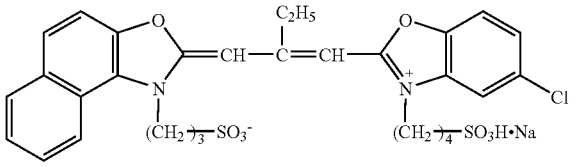

Sensitizing dye 3

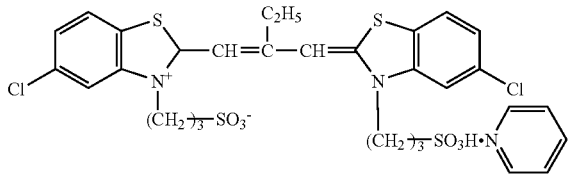

-continued

Sensitizing dye 4

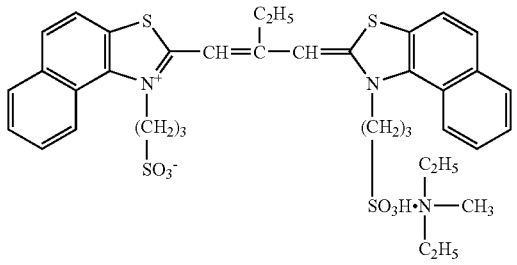

Sensitizing 5

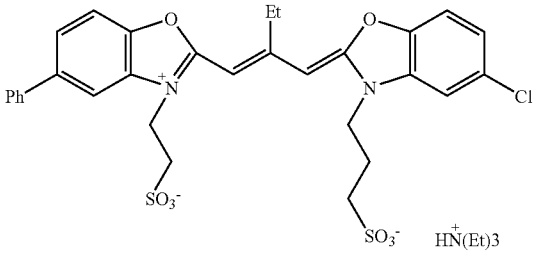

Sensitizing dye 6

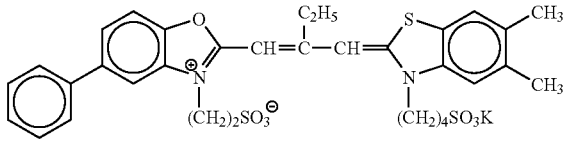

-continued

Sensitizing dye 7

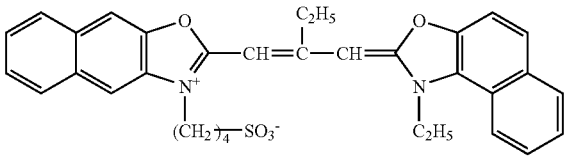

Sensitizing dye 8

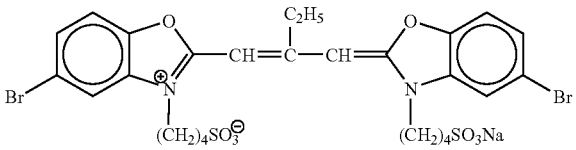

Sensitizing dye 9

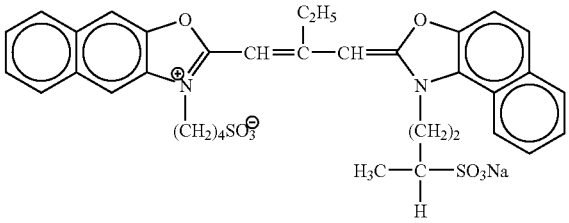

Sensitizing dye 10

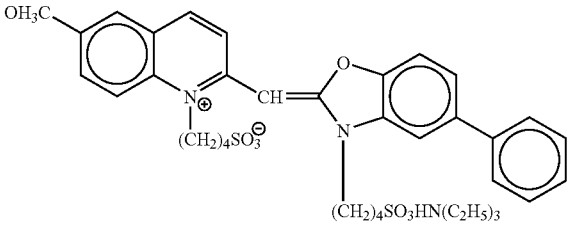

-continued

Sensitizing dye 11

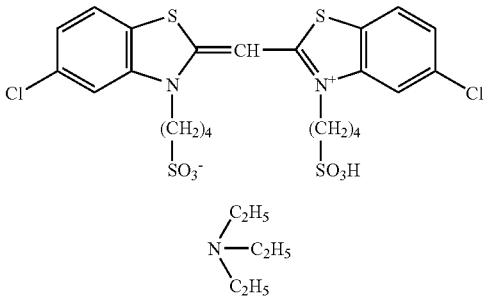

Sensitizing dye 12

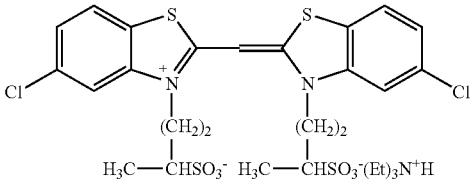

Sensitizing dye 13

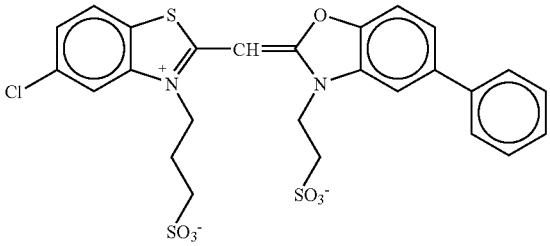

Sensitizing dye 14

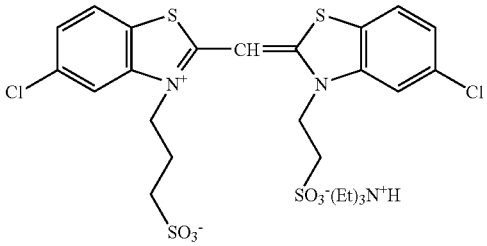

(Preparation of Samples 202 to 209)

The samples were prepared in the same manner as in the sample 201 except that the dye was added and the non high molecular weight ultraviolet absorbent of the 15$^{th}$ layer was replaced as shown in Table 7 in the sample 201.

TABLE 7

| | Cyan dye D-32 | | | Emulsion (14$^{th}$ layer) | | | Green-sensitive layer | | Preservation | |
|---|---|---|---|---|---|---|---|---|---|---|
| Sample No. | Layer added | Addition amount (mg/m$^2$) | Ultraviolet absorbent (15$^{th}$ layer) | Emulsion name | Coating amount (g/m$^2$) | Aspect ratio | Sensitivity | Sharpness Relative MTF (25 c/mm) | property (30° C., 90%, 3 days) | Remark |
| 201 | — | — | UV-1, 6, 10, 16, 32 | Em-K<br>Em-L | 0.397<br>0.458 | 4.0 | Control | 100 | Control | Comp. |
| 202 | 11$^{th}$ layer<br>14$^{th}$ layer | 3.5<br>2.8 | UV-1, 6, 10, 16, 32 | Em-K<br>Em-L | 0.397<br>0.458 | 4.0 | −0.04 | 106 | −0.11 | Comp. |
| 203 | — | — | A | Em-K<br>Em-L | 0.397<br>0.458 | 4.0 | −0.03 | 81 | −0.03 | Comp. |

TABLE 7-continued

| | Cyan dye D-32 | | | Emulsion (14th layer) | | | Green-sensitive layer | | Preservation | |
|---|---|---|---|---|---|---|---|---|---|---|
| Sample No. | Layer added | Addition amount (mg/m$^2$) | Ultraviolet absorbent (15th layer) | Emulsion name | Coating amount (g/m$^2$) | Aspect ratio | Sensitivity | Sharpness Relative MTF (25 c/mm) | property (30° C., 90%, 3 days) | Remark |
| 204 | 11th layer | 3.5 | A | Em-K | 0.397 | 4.0 | −0.02 | 108 | −0.01 | Inv. |
| | 14th layer | 2.8 | | Em-L | 0.458 | | | | | |
| 205 | 11th layer | 3.5 | B | Em-K | 0.397 | 4.0 | −0.02 | 107 | −0.03 | Inv. |
| | 14th layer | 2.8 | | Em-L | 0.458 | | | | | |
| 206 | 14th layer | 3.8 | A | Em-K | 0.397 | 4.0 | −0.02 | 112 | −0.01 | Inv. |
| | 15th layer | 2.5 | | Em-L | 0.458 | | | | | |
| 207 | 14th layer | 3.8 | B | Em-K | 0.397 | 4.0 | −0.03 | 110 | −0.02 | Inv. |
| | 15th layer | 2.5 | | Em-L | 0.458 | | | | | |
| 208 | 15th layer | 6.3 | A | Em-K | 0.397 | 4.0 | −0.02 | 116 | 0.00 | Inv. |
| | | | | Em-L | 0.458 | | | | | |
| 209 | 15th layer | 6.3 | B | Em-K | 0.397 | 4.0 | −0.02 | 113 | −0.01 | Inv. |
| | | | | Em-L | 0.458 | | | | | |
| 210 | — | — | UV-1, 6, 10, 16, 32 | Em-K' | 0.855 | 2.5 | −0.01 | 101 | −0.02 | Comp. |
| 211 | 15th layer | 6.3 | A | Em-K' | 0.855 | 2.5 | −0.03 | 107 | −0.03 | Inv. |

The method of adding the cyan dye D-32 is as follow. 19.0 g of the cyan dye (D-32) and 16 ml of a high boiling organic solvent (HBS-1) were added to 100 ml of ethyl acetate, and the mixture was heated to 40° C. to be completely dissolved. The ethyl acetate solution was mixed with 400 g of a 13% gelatin aqueous solution which contains 7.0 g of a surfactant (W-4), and the mixed solution was dispersed to emulsion with a homo-blender. The emulsified dispersion thus obtained was added to the objective layer.

The wedge exposure of the samples prepared as above was carried out with white light and then, development processing was carried out by the similar processing step as Example 1 to measure their concentrations. The sensitivities were evaluated by the logarithm of the reciprocal number of exposure providing the concentration of a cyan concentration plus 0.5. Sharpnesses were determined by exposing the MTF pattern and carrying out the similar processing as the above-description. Further, after the samples were aged in a temperature of 30° C. and a humidity of 90% for 3 days, the wedge exposure was carried out with white light and then, the development processing was similarly carried out to measure their concentrations. The change of gradation at aging was evaluated by the concentration change at a yellow concentration of 1.5. The results obtained as above are collectively described in Table 7.

As cleared from Table 7, it is grasped that when a fixed cyan dye is charged in a photographic composing layer which is farther than the red-sensitive emulsion layer from a support, sharpness is remarkably improved by combination with the polymer impregnated with the ultraviolet absorbent in comparison with expectation. Further, it is grasped that it has an effect for improving the deterioration of preserving property caused by the fixed cyan dye.

What is claimed is:

1. A silver halide color photosensitive material having photographic composing layers including at least one red-sensitive silver halide emulsion layer, at least one green-sensitive silver halide emulsion layer and at least one blue-sensitive silver halide emulsion layer in order from the side near a support, the silver halide color photosensitive material containing a magenta dye which is fixed in the photographic composing layer which exists at a position farther than the green-sensitive silver halide emulsion layer with a support as a basis and is not colored by a coupling reaction with developing agent oxidation products, and/or containing a cyan dye which is fixed in the photographic composing layer which exists at a position farther than the red-sensitive silver halide emulsion layer with a support as a basis and is not colored by a coupling reaction with developing agent oxidation products, and containing an ultraviolet absorptive polymer latex represented by the formula (I) which is impregnated with a non high molecular weight ultraviolet absorptive compound in at least one photographic composing layer:

Formula (I)

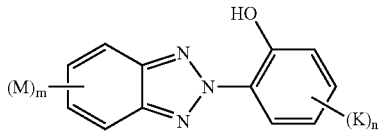

wherein a phenyl ring or a benzo ring may be optionally substituted, either of m or n is 1 and another is 0, and M and K are represented by the following formula (II):

Formula (II)

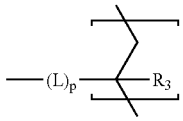

wherein $R_3$ is H or an alkyl group, L is a divalent binding group, and p is 0 or 1.

2. The silver halide color photosensitive material according to claim 1, wherein the magenta dye or the cyan dye which is not colored by a coupling reaction with developing agent oxidation products is contained in the same layer as the polymer latex-containing layer or a layer which exists at a position farther than the polymer latex-containing layer.

3. The silver halide color photosensitive material according to claim 1, wherein at least 50% or more of the total projected area of the silver halide grains contained in the blue-sensitive silver halide emulsion layer which exists at a position farthest from the support is occupied by tabular silver halide grains with an aspect ratio of 3 or more.

4. The silver halide color photosensitive material according to claim 2, wherein at least 50% or more of the total projected area of the silver halide grains contained in the blue-sensitive silver halide emulsion layer which exists at a position farthest from the support is occupied by tabular silver halide grains with an aspect ratio of 3 or more.

* * * * *